US009486851B2

(12) United States Patent
Mizumura et al.

(10) Patent No.: US 9,486,851 B2
(45) Date of Patent: Nov. 8, 2016

(54) APPARATUS AND METHOD FOR RAM BENDING OF TUBE MATERIAL

(75) Inventors: Masaaki Mizumura, Tokyo (JP); Yukihisa Kuriyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 478 days.

(21) Appl. No.: 12/449,616

(22) PCT Filed: Oct. 16, 2007

(86) PCT No.: PCT/JP2007/070505
§ 371 (c)(1),
(2), (4) Date: Aug. 17, 2009

(87) PCT Pub. No.: WO2008/102477
PCT Pub. Date: Aug. 28, 2008

(65) Prior Publication Data

US 2010/0011832 A1 Jan. 21, 2010

(30) Foreign Application Priority Data

Feb. 21, 2007 (JP) ..... 2007-041283

(51) Int. Cl.
*B21D 7/06* (2006.01)

(52) U.S. Cl.
CPC ..... *B21D 7/06* (2013.01); *B21D 7/066* (2013.01)

(58) Field of Classification Search
CPC ..... B21D 7/04; B21D 7/06; B21D 7/066
USPC ..... 72/389.1, 149, 152, 154, 166, 367.1, 72/369, 386, 207, 387–388, 212–217
See application file for complete search history.

(56) References Cited

U.S. PATENT DOCUMENTS

| | | | | |
|---|---|---|---|---|
| 2,277,204 A | | 3/1942 | Byler | |
| 2,327,440 A | * | 8/1943 | Maize | 72/399 |
| 2,405,931 A | * | 8/1946 | Abramson et al. | 72/383 |
| 2,880,779 A | * | 4/1959 | Mingori | 72/213 |

(Continued)

FOREIGN PATENT DOCUMENTS

| | | |
|---|---|---|
| DE | 3711970 | 10/1988 |
| JP | 54-95544 | 7/1979 |

(Continued)

OTHER PUBLICATIONS

International Search Report dated Nov. 27, 2007 issued in corresponding PCT Application No. PCT/JP2007/070505.

(Continued)

*Primary Examiner* — Matthew G Katcoff
(74) *Attorney, Agent, or Firm* — Birch, Stewart, Kolasch & Birch, LLP

(57) ABSTRACT

The present invention provides a new bending apparatus and bending method of a tube material which makes it possible to achieve all of bending by a large bending radius not requiring large scale equipment or die, bending resistant to wrinkling and buckling at an inner side of the bending, and bending with a high productivity, that is, a ram bending apparatus using a punch 12 and a set of rolls 13, 13 for three-point bending of a tube material wherein the punch 12 has a groove 12*a* of a width of the width of a circular tube 11 or more and wherein the set of rolls 13, 13 are supported by a frame 14. The rolls 13, 13 can freely move on the frame 14 in directions away from each other in a state contacting the punch 12. The frame 14 has a hollow space 14*a* enabling free movement of the descending punch 12 and the circular tube 11 bent along with this during the bending of the circular tube 11.

20 Claims, 25 Drawing Sheets

(56) References Cited

U.S. PATENT DOCUMENTS

| | | | | |
|---|---|---|---|---|
| 4,446,711 | A | 5/1984 | Valente | |
| 5,237,847 | A | 8/1993 | Owens | |
| 5,390,522 | A * | 2/1995 | Dircks | 72/217 |
| 5,615,572 | A * | 4/1997 | Johnson et al. | 72/389.1 |
| 5,956,991 | A * | 9/1999 | Tseng | 72/213 |
| 6,523,388 | B1 * | 2/2003 | Winton, III | 72/389.1 |
| 6,644,087 | B1 | 11/2003 | Ralph et al. | |

FOREIGN PATENT DOCUMENTS

| | | |
|---|---|---|
| JP | 55-11245 | 1/1980 |
| JP | 58-185324 | 12/1983 |
| JP | 58-215224 | 12/1983 |
| JP | 03-32427 | 2/1991 |
| JP | 6-198348 | 7/1994 |

OTHER PUBLICATIONS

"Tube Forming" Colona Publishing Co. Ltd. p. 36-64.

Mizumura et al. "Theoretical Analysis of Three-Point Bending with Flattening of Tube", Journal of the Japan Society Technology of Plasticity, vol. 44, No. 508 (2003) p. 530.

European Search Report dated Jun. 6, 2013 issued in corresponding European Application No. 07830239.5.

* cited by examiner (b)

(a)

APPARATUS AND METHOD FOR RAM BENDING OF TUBE MATERIAL

This application is a national stage application of International Application No. PCT/JP2007/070505, filed 16 Oct. 2007, which claims priority to Japanese Application No. 2007-041283, filed 21 Feb. 2007, which is incorporated by reference in its entirety.

TECHNICAL FIELD

The present invention relates to a bending apparatus and a bending method of a tube material when manufacturing auto parts, building material parts, furniture parts, and the like.

BACKGROUND ART

Recently, in the fields of auto parts, building material parts, furniture parts, etc., it has been demanded to lighten the weight as much as possible in a state securing rigidity. As one means for this, making the materials hollow is effective. On the other hand, these parts are increasing being bent in view of the needs for arrangement in small spaces, aesthetic design, assembly of a plurality of parts, etc.

There are very many types of bending methods of tube materials. If giving several examples from "Tube Forming", page 36 to page 64 (Oct. 30, 1992, Corona Publishing Co., Ltd.), there are draw bending (see FIG. 1), ram bending (see FIG. 2), press bending (see FIG. 3), and the like.

Among these, draw bending is the method most generally being used. The advantage is that a wiper die, mandrel, pressure die, etc. constrain the tube material, so there is resistance to wrinkling or buckling at the inner side of bending and bending by a small bending radius is possible. However, put another way, when performing one type of bending, there is the disadvantage that many dies become necessary. Further, bending by a small bending radius is a strong point, but when bending by a large bending radius, a large rotary bending die becomes necessary. Further, it is necessary that the apparatus itself be enlarged. To avoid enlargement of the apparatus, by practice has sometimes been to performing bending by a small bending radius and linear shaping repeatedly to make the overall result close to that of bending by a large bending radius, but this means a plurality of bending operations, so the cycle time becomes longer and the productivity is therefore no good. Further, there are the drawbacks that the bent shape is only a circular arc and further in principle bending by only one type of bending radius is possible.

On the other hand, ram bending includes the system as shown in FIG. 2 of using a bending die and support rollers and also the case, as shown in FIG. 4 ("Journal of the Japan Society for Technology of Plasticity", Vol. 44, No. 508 (2003), page 530), where the support points do not rotate. There are the advantages that ram bending, compared with the aforementioned draw bending, requires fewer dies and, further, because bending is possible with just the movement of a punch (the bending die in FIG. 2), the productivity is high. However, there is less constraint by surrounding dies, wrinkling and buckling easily occur at the inner side of bending. In particular, when the distance between the support points is large, buckling such as crumpling easily occurs at the location pressed by the punch.

Press bending is a method as shown in FIG. 3 which bends a tube material while a pressure die rotates around a bending die. It is relatively similar to the aforementioned draw bending, but they differs in whether the bending die rotates or whether the pressure die rotates. For the pressure die, other than when using a die such as in FIG. 3, there is also the example of utilizing a roll such as in FIG. 5 (Japanese Patent Publication (A) No. 3-32427) (note that in FIG. 5, (a) to (d) show, respectively, FIG. 1 to FIG. 4 of Japanese Patent Publication (A) No. 3-32427, in which 1 is a fixed die, 2 is a guide surface, 3 is a groove, 4 is a support shaft, 4a is a pinion rack, 5 is a press fluid pressure cylinder, 6 is a bearing frame, 7 is a pressure die, 7a is a spindle, 8 is a groove, 9 is a rotary fluid pressure cylinder, 10 is a hole type die, P is a material tube, and Pa is a front end part). However, the drawbacks that the bending shape is limited to a circular arc and that bending by a large bending radius is difficult in terms of equipment are similar to the case of draw bending.

DISCLOSURE OF THE INVENTION

As described above, in the existing apparatuses and methods for bending a tube material, it was not possible to achieve the three characteristics of bending by a large bending radius without requiring large scale facilities or dies, bending resistant to wrinkling and buckling at the inner side of the bending, and bending with a high productivity. Therefore, the present invention has its object to provide a new bending apparatus and bending method of a tube material enabling these three characteristics to be obtained simultaneously.

In order to solve these problems, the present invention has as its gist the following:

(1) A ram bending apparatus of a tube material using a punch and a set of rolls for three-point bending of a tube material, said ram bending apparatus of a tube material characterized in that said punch has a groove of a width of the width of said tube material or more in its outer circumference, said set of rolls are supported by a frame and can freely move on said frame in directions away from each other in a state contacting said punch, and said frame has a hollow part for enabling said punch and said tube material to freely move during bending of said tube material.

(2) A ram bending apparatus of a tube material using a single roll in a state fastening part of a tube material with a punch so as to press the tube material against the punch to bend it, said ram bending apparatus of a tube material characterized in that said punch has a groove of a width of the width of said tube material or more in its outer circumference, said roll is supported by a frame and can freely move in a state contacting said punch, and said frame has a hollow part for enabling said punch and said tube material to freely move during bending of said tube material.

(3) A ram bending apparatus of a tube material as set forth in (1) or (2), characterized in that part or all of the cross-sectional shapes of the grooves of center part(s) of said roll(s) and said punch comprise semicircular shapes, elliptical shapes, rectangular shapes, polygonal shapes, or shapes of combinations of curved lines.

(4) A ram bending apparatus of a tube material as set forth in any one of (1) to (3), characterized in that part of said tube material is burled and a hollow part able to fit over said burled part is provided in said punch.

(5) A ram bending apparatus of a tube material as set forth in any one of (1) to (4), characterized in that said roll(s) can rotate with respect to said frame.

(6) A ram bending apparatus of a tube material as set forth in any one of (1) to (5), characterized in that said roll(s) can rotate with respect to said punch.

(7) A ram bending apparatus of a tube material as set forth in (6), characterized by having driving means driving rotation of said roll(s) in a direction(s) making the tube material advance toward the tube ends.

(8) A ram bending apparatus of a tube material as set forth in (6), characterized by having driving means driving rotation of said roll(s) in a direction(s) making a tube material advance toward a direction opposite to the tube ends.

(9) A ram bending apparatus of a tube material as set forth in any one of (1) to (8), characterized in that said roll(s) can freely move in an axial direction of the roll(s).

(10) A ram bending apparatus of a tube material as set forth in any one of (1) to (9), characterized by a surface of said frame on which said roll(s) moves forms an acute angle with a direction of progression of said punch.

(11) A ram bending method of a tube material characterized by inserting a tube material into a groove provided in an outer circumference of a punch, clamping the tube material by a set of rolls positioned at an opposite side of the tube material from said punch and supported by a frame and by part of said punch and making said punch move to said frame side, and making said pair of rolls moves on said frame in directions away from each other in a state contacting said punch so as to bend the tube material to the groove shape of said punch.

(12) A ram bending method of a tube material characterized by fastening part of a tube material to a punch and, in that state, pushing the tube material and said punch in the fastened state against a single roll positioned at an opposite side of the tube material from said punch and supported by a frame, making part of said punch and said roll contact each other, clamping the tube material with said roll in a groove provided in said punch, and, in that state, making said punch move to said roll side, and making said roll moves on said frame along said punch in the state contacting said punch so as to bend the tube material along the groove shape of said punch.

(13) A ram bending method of a tube material as set forth in (11) or (12) characterized by using a punch and a roll(s) with part or all of the cross-sectional shapes of the grooves of center part(s) of said roll(s) and said punch comprising semicircular shapes, elliptical shapes, rectangular shapes, polygonal shapes, or shapes of combinations of curved lines so as to make a cross-sectional shape of the tube material deform and simultaneously bend the material.

(14) A ram bending method of a tube material as set forth in any one of (11) to (13), characterized by using a partially burled tube material for bending.

(15) A ram bending method of a tube material as set forth in any one of (11) to (14), characterized by bending said material while making said roll(s) rotate with respect to said frame.

(16) A ram bending method of a tube material as set forth in any one of (11) to (15), characterized by bending said material while making said roll(s) rotate with respect to said punch.

(17) A ram bending method of a tube material as set forth in (16), characterized by bending said material while driving rotation of said roll(s) in a direction(s) which makes the tube material advance toward the tube ends.

(18) A ram bending method of a tube material as set forth in (16) characterized by bending said material while driving rotation of said roll(s) in a direction(s) which makes the tube material advance toward a direction(s) opposite to the tube ends.

(19) A ram bending method of a tube material as set forth in any one of (11) to (18), characterized by bending said material while making said roll(s) move in an axial direction of the roll(s).

(20). A ram bending method of a tube material as set forth in any one of (11) to (19), characterized by bending said material while making said roll(s) move by an acute angle with respect to a direction of progression of said punch.

BEST MODE FOR CARRYING OUT THE INVENTION

Figure 1:
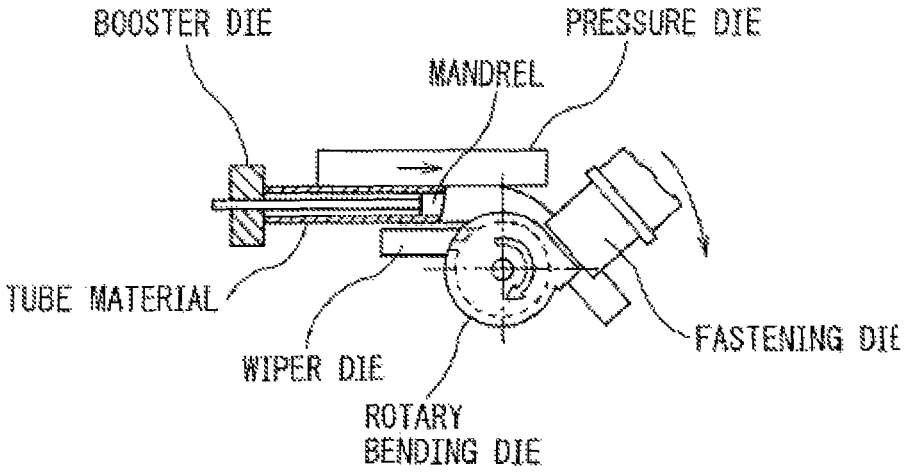
FIG.1 (Prior Art)
FIG. 1 is a view explaining a conventional rotary-draw bending method.
Figure 2:
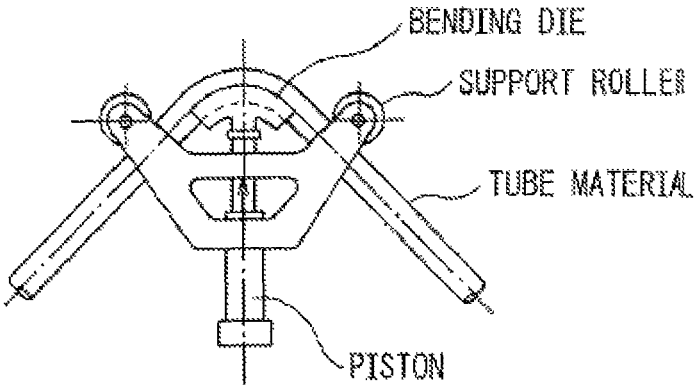
FIG.2 (Prior Art)
FIG. 2 is a view explaining a conventional ram bending method.
Figure 3:
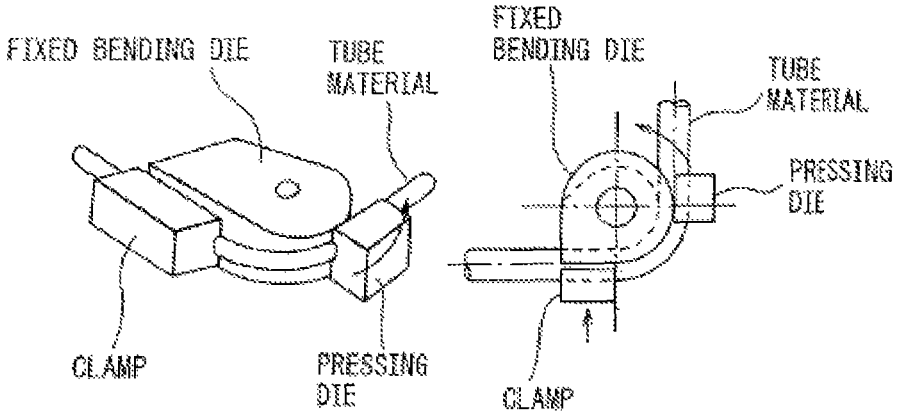
FIG. 3 (Prior Art)
FIG. 3 gives views explaining a conventional press bending method.
Figure 4:
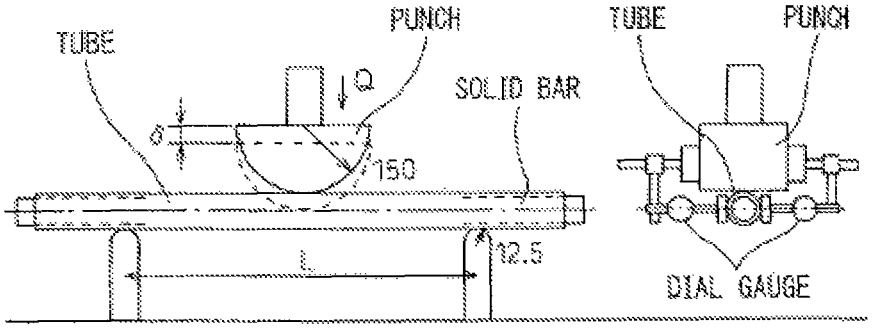
FIG. 4 (Prior Art)
FIG. 4 gives views explaining a conventional ram bending method in which the support points do not rotate.
Figure 5:
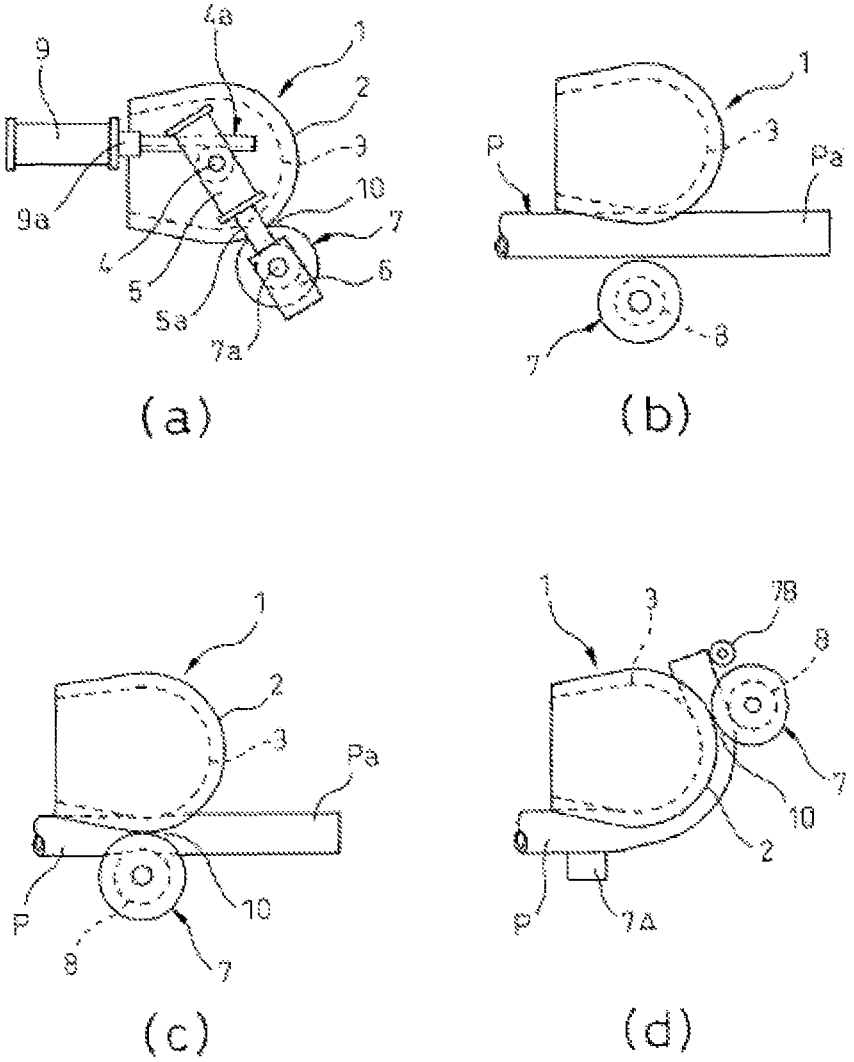
FIG. 5 (Prior Art)
FIG. 5 gives views explaining a conventional press bending method.
Figure 6:
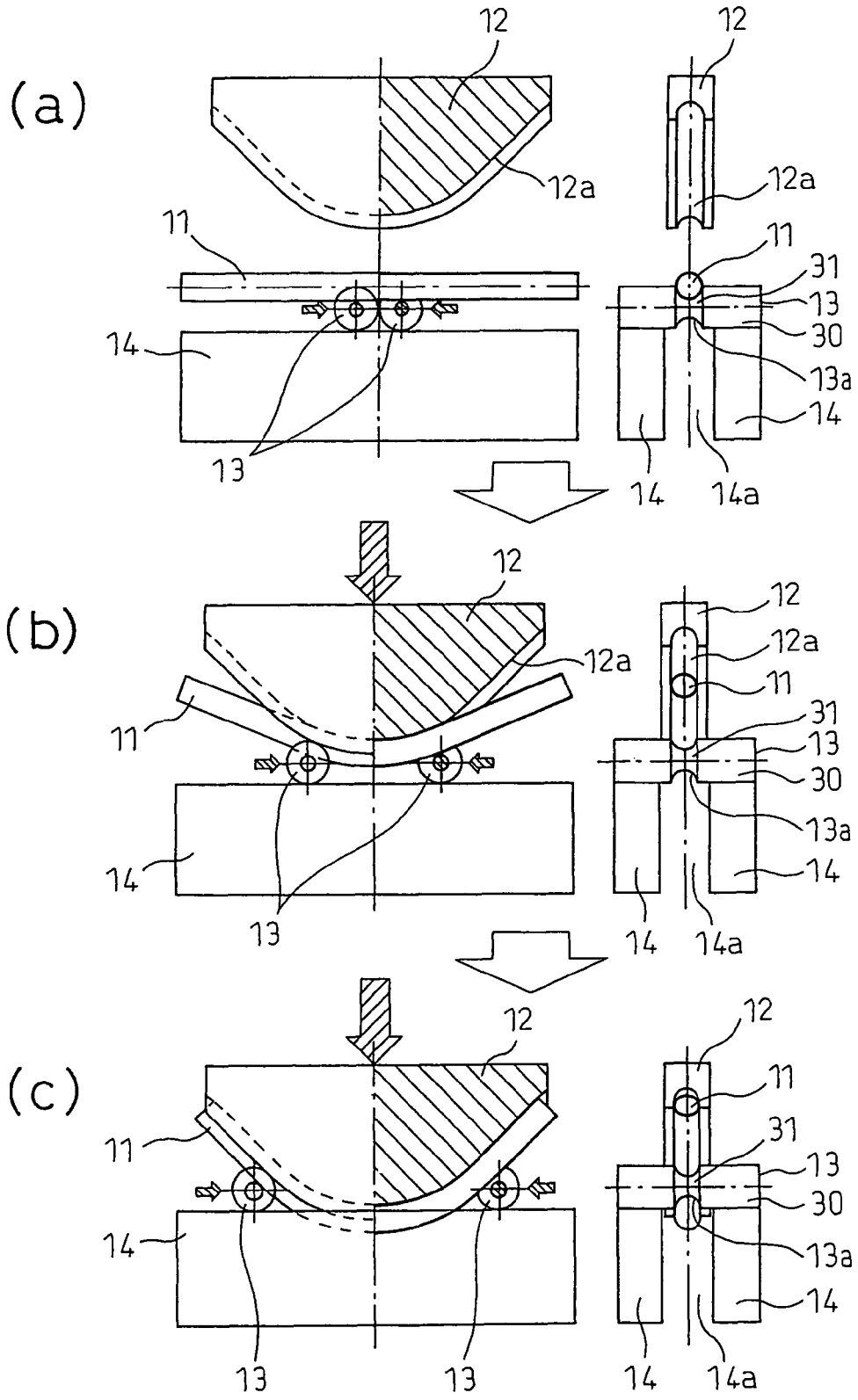
FIG. 6 gives front views including partial cross-sectional views and side views explaining in sequence a bending method in the case of using one set of rolls of the present invention ((a)→(b)→(c)).

FIG. 6 shows an example of bending a center of circular tube (tube material) 11 in a circular arc shape by a processing apparatus according to an embodiment of the present invention. From here, the figure will be used to explain details of the processing apparatus and processing method of the present invention. Note that in the figure, front views of the structure of the apparatus as a whole are shown on the left, while the side views are shown on the right. Further, the right sides from the center lines of the front views are external views, while the right sides from the center lines are the central cross-sectional views.

First, the structure of the apparatus as a whole will be explained. The apparatus is comprised of a punch 12, a set of rolls 13, 13 (two), and a frame 14. At the circumferential surface of the punch 12 which contacts the circular tube 11, a groove of the same cross-section as the upper half of the circular tube 11, that is, a groove 12*a* of a width equal to the diameter (width) of the circular tube 11 and of semicircular cross-section is provided. The center parts 31 of the rolls 13 contacting the circular tube 11 form hourglass shapes having grooves of the same cross-sections as the lower half of the circular tube 11, that is, grooves 13*a* of widths equal to the diameter (width) of the circular tube 11 and of semicircular cross-sections. The frame 14 supporting the rolls 13, if seen from the side surface, has a hollow space 14*a* of a width larger than the width of both of the punch 12 and circular tube 11. The descending punch 12 and the circular tube 11 bent based along with that can freely move to the hollow space 14*a* side. Note that in this example, the frame 14 is structured completely divided into two parts, but if the hollow part is of a sufficient size, there is no problem even if the frame is a single piece at its bottom side. Further, the pair of rolls 13, 13 are set on the frame 14, and the end parts 30 of the rolls 13 contacting the frame 14 and the circumference of the punch 12 become columnar shapes, so they can move over the top of the frame 14.

Next, the processing method of the present invention will be described in sequence from (a) of FIG. 6. (a) shows the initial state. The positions of the two rolls 13, 13 on the frame 14 are set to the center. The rolls may contact each other as in the figure. A stopper etc. may be provided between the rolls 13, 13 and this contacted instead. In either case, a pressing force is applied in the direction bringing the rolls 13, 13 close to each other (the horizontal direction arrows in the figure). The method of application of the force may be hydraulic cylinders, springs, and the like. A circular tube 11 is placed further above the set of rolls 13, 13 set on the frame 14 as explained above.

Next, as shown in (b) of the same figure, the punch 12 descends from above the circular tube 11 (proceeds to the frame 14 side). This being the case, the semicircular shaped groove 12*a* of the punch 12 and the semicircular shaped grooves 13*a* of the center parts 31 of the rolls 13 grip the circular tube 11 between then. Simultaneously, the punch 12 and the end parts 30 of the rolls 13 mutually contact each other at the outside parts of the grooves 12*a*, 13*a*. Since the center of the outer circumferential surface of the punch 12 in this example is a circular arc shape, if the punch 12 is pushed downward in the vertical direction, force will act trying to make the rolls 13, 13 move in directions separating from each other (outside). However, as described above, force trying to make the rolls 13, 13 approach each other is acting, so as a result the end parts 30 of the rolls 13, 13 move over the frame 14 so as to follow the outer circumferential surface of the punch 12 while contacting the punch 12 along with the descent of the punch 12. Due to the above movement of the rolls 13, 13, the circular tube 11 can be bent so as to be pressed against the punch 12 by the pair of rolls 13, 13.

Finally, as shown in (c) of the same figure, when the rolls 13 reach to the location of the straight line parts of the punch 12, the bending is complete. Note that when detaching the circular tube 11 after bending, if simply making the punch 12 rise, the tube can be easily taken out.

The above was an explanation of a ram bending apparatus and method of a tube material in the case of using a set of rolls 13 proposed in the aspect of the invention relating to the above (1) and the aspect of the invention relating to (11). Next, FIG. 7 will be used to explain a ram bending apparatus and method of a tube material in the case of using a one roll 13 proposed in the aspect of the invention relating to the above (2) and the aspect of the invention relating to the above (12).

Figure 7:
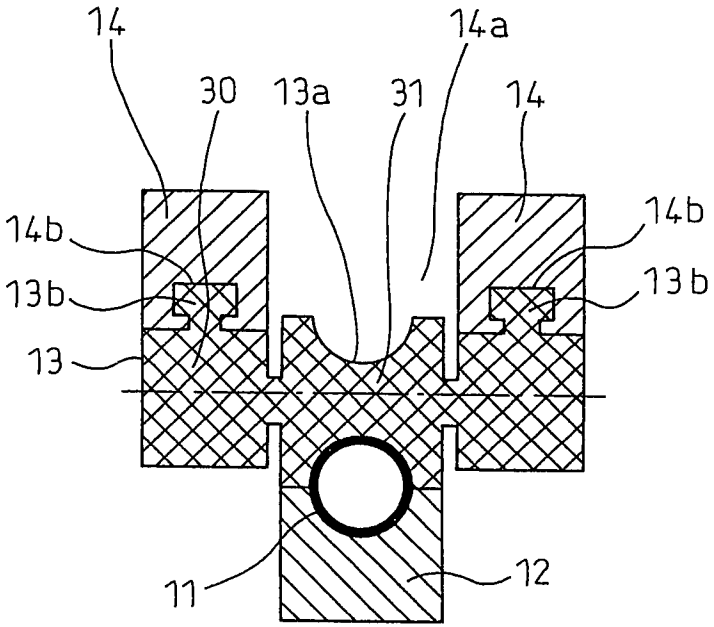
FIG. 7 gives views explaining a bending method in the case of using one roll of the present invention, wherein (a) is a cross-sectional view, and (b) is an A-A cross-sectional view of (a).
Figure 7:
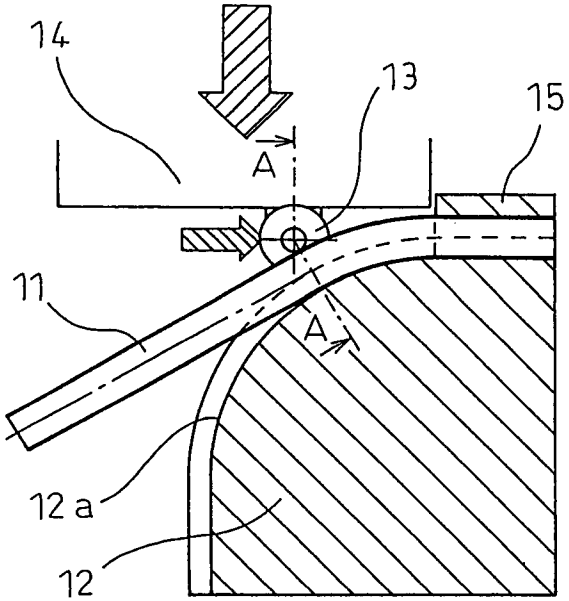

FIG. 7 is an example where the punch 12 is arranged below and the frame 14 and the roll 13 are arranged above. First, a fastening jig 15 is used to fasten a right end of the circular tube 11 on the punch 12. Note that in the outer circumferential surface of the punch 12 contacting the circular tube 11 is provided with a groove comprised of a semicircular shape of the same cross-section as the lower half of the circular tube 11, that is, a groove 12*a* of a width equal to the diameter (width) of the circular tube 11. The center part 31 of the roll 13 contacting the circular tube 11 forms hourglass shape having grooves comprised of semicircular shapes of the same cross-sections as the lower half of the circular tube 11, that is, grooves 13*a* of widths equal to the diameter (width) of the circular tube 11. The frame 14 supporting the roll 13, if seen from the side surface, has a hollow space 14*a* of a width larger than the widths of both the punch 12 and the circular tube 11. Inside the hollow space 14*a*, and the punch 12 and the circular tube 11 can move freely. Further, the tops of the end parts 30 of the roll 13 contacting the frame 14 are provided with T-shaped projections 13*b*. The bottom of the frame 14 is formed with guide grooves 14*b* having cross-sections matching the cross-sections of the projections 13*b*. The projections 13*b* of the roll 13 fit into the guide grooves 14*b* of the frame 14 whereby the roll 13 is supported by the frame 14. At this time, simultaneously, the roll 13 is designed to be guided by the guide grooves 14*b* and move along the bottom surface of the frame 14. Further, the end parts 30 of the roll 13 contacting the outer circumferential part of the punch 12 and the frame 14 form columnar shapes.

According to this example, the frame 14 and the roll 13 is made to descend as is in an integral state in the direction of the punch 12 and the circular tube 11. The roll 13 is acted upon by a force pressing it in the right direction (the horizontal arrow direction in the figure). As a result, along with the descent of the frame 14 and the roll 13, the roll 13 moves in a state contacting the punch 12. Therefore, the circular tube 11 clamped between the roll 13 and the punch 12 is bent to a shape along the groove 12*a* of the punch 12. Finally, when the roll 13 reach the straight line parts of the punch 12, the bending is complete. After that, if making the frame 14 and the roll 13 rise, it is possible to take out the bent circular tube 11.

In the above example of FIG. 6, the punch 12 was arranged above, while in the example of FIG. 7, the punch 12 was arranged below, but similar results can be obtained even if arranging the conversely. Namely, it is also possible to arrange the punch 12 of the example of FIG. 6 below, place the circular tube 11 on that and make the frame 14 and rolls 13 descend from above and possible to arrange the frame 14 and the roll 13 of the example of FIG. 7 below and make the punch 12 to which part of the circular tube 11 is fastened descend from above together with the circular tube 11. Further, these arrangements need not be vertical. It is also possible to arrange everything in the horizontal direction and make the punch 12 or the frame 14 and the rolls 13 move in the horizontal direction.

As advantages of the present invention, first, the apparatus is simple, so the cost can be kept low. Basically, just a press apparatus is sufficient. The apparatus is simple, so the cost is low. Further, when bending different bent shapes, it is sufficient to remake only the punch 12. The rolls 13 and the frame 14 can be used in common, so the die costs can also be reduced.

As a second advantage, a high productivity can be mentioned. In the usual draw bending, even a single bending operation took about 20 to 30 seconds. If several bending operations, a minute or more was sometimes required. Compared to this, with the bending method of the present invention, a single press operation is sufficient for bending, so bending is possible in several seconds.

As a third advantage, there is the point of resistance to wrinkling and buckling. In ram bending by three-point bending with the positions of the support points fixed, wrinkling and buckling easily occur at the inner side of the bending. However, in the bending method according to the present invention, the distance between the support points, namely, the distance between the rolls 13, 13 or the distance between the roll 13 and the fastening jig 15, is initially short, so there is resistance to crumpling. Along with the progress of the bending, the distance between the support points gradually increases for sequential bending, so finally a shape free of wrinkling and buckling can be formed.

Figure 8:
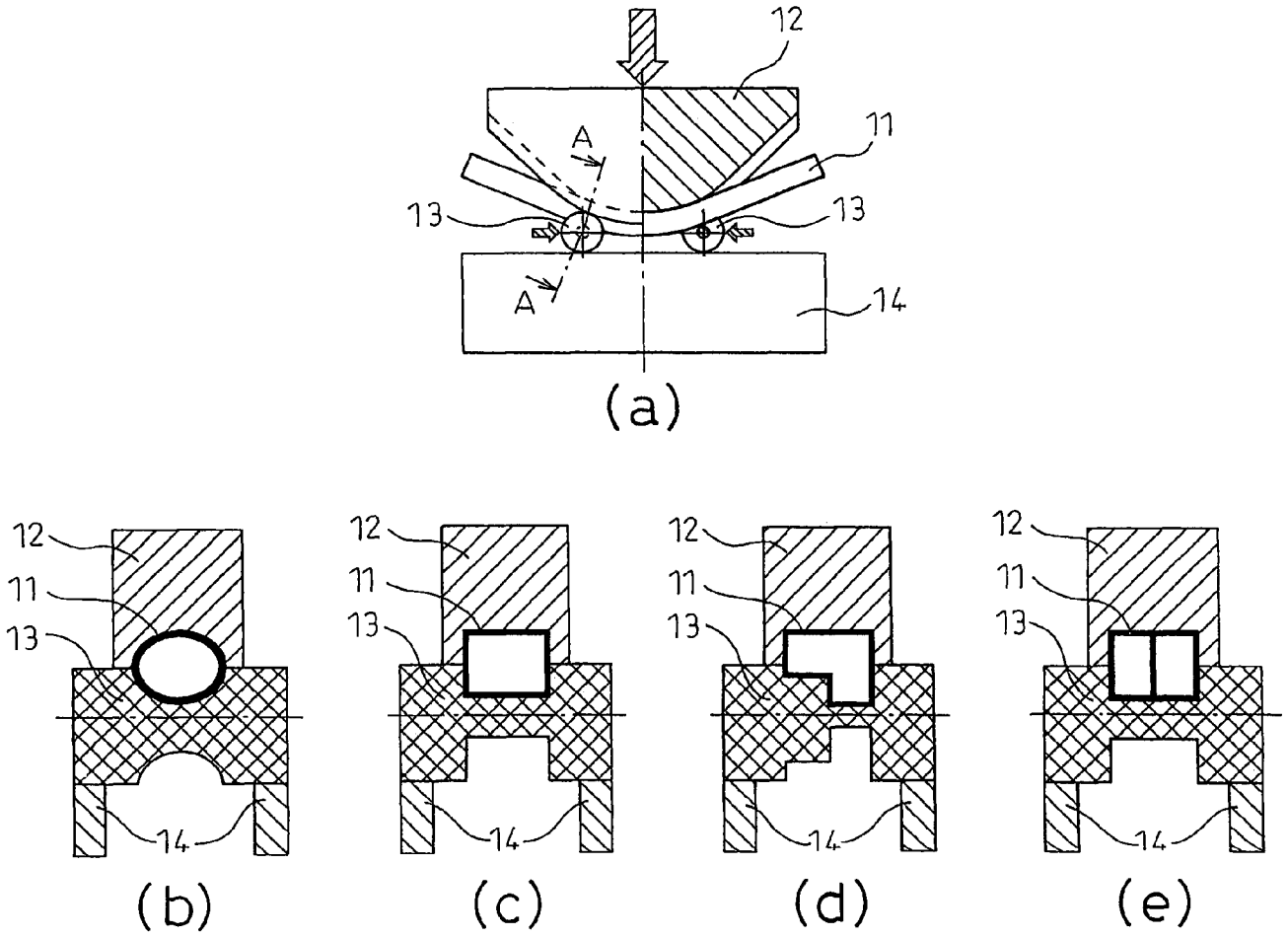
FIG. 8 gives views showing the bending method of the present invention and the cross-sectional shape of a tube material used in the present invention, wherein (a) is a front view including a partial cross-sectional view showing a bending method in the case of using one set of rolls of the present invention and (b) to (e) are views showing examples of the shape of the A-A cross-section in (a) of the tube material used in the present invention.

In this example, a circular tube 11 was used for the bending, but the cross-sectional shape of the tube material need not be circular. As shown in the examples of (b) to (d) of FIG. 8, the present invention is also applicable to elliptical, rectangular, and other irregular cross-sections. Further, as shown in the example of (e) of FIG. 8, the present invention is also applicable to a tube material which has an inside rib such as a cross-section of a shape of two rectangular shapes arranged alongside each other such as produced by aluminum extruded materials or to a tube material with a rib at the outside. In that case, it is sufficient to make the cross-sectional shape of the groove 12*a* of the punch 12 and the cross-sectional shapes of the grooves 13*a* of the center parts 31 of the rolls 13 shapes matching with the cross-sectional shapes of the respective tube materials.

Figure 9:
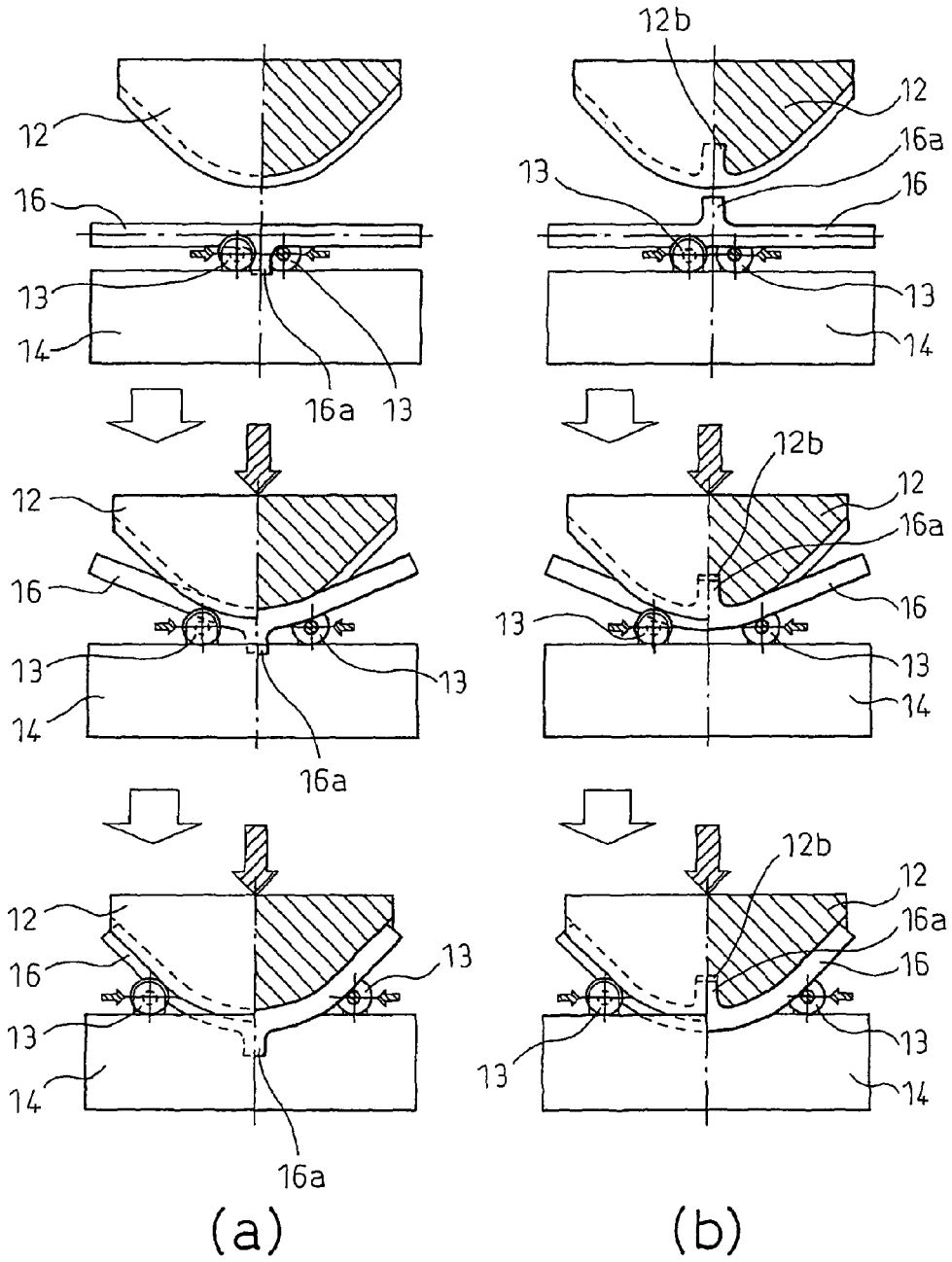
FIG. 9 gives front views including partial cross-sectional views explaining the order in the case of bending using a hydroformed part in the present invention, wherein (a) shows the case where a burled part of the hydroformed part is at a roll side, and (b) shows the case where the burled part of the hydroformed part is at the side where a punch is present.

Further, as shown in the example of FIG. 9, it is also possible to use a worked part 16 preformed by hydroforming or the like. (a) of the figure is an example where the hydroformed burled part 16*a* constituting the bulged out part is at the side where the rolls 13, 13 are present. In this case, if the burled part 16*a* can be arranged at a position not interfering with the rolls 13, 13 in the initial state, the bending method of the present invention can be utilized as it is. Further, (b) of the figure is an example where the hydroformed burled part 16*a* is in the direction where the punch 12 is present. In this case, if the providing a recessed part 12*b* (in the example of FIG. 9, the lower part of the center of the punch 12) as a hollow part at the position where the punch 12 strikes the burled part 16*a*, shaping is possible without crushing the burled part 16*a* at the time of bending.

Figure 10:
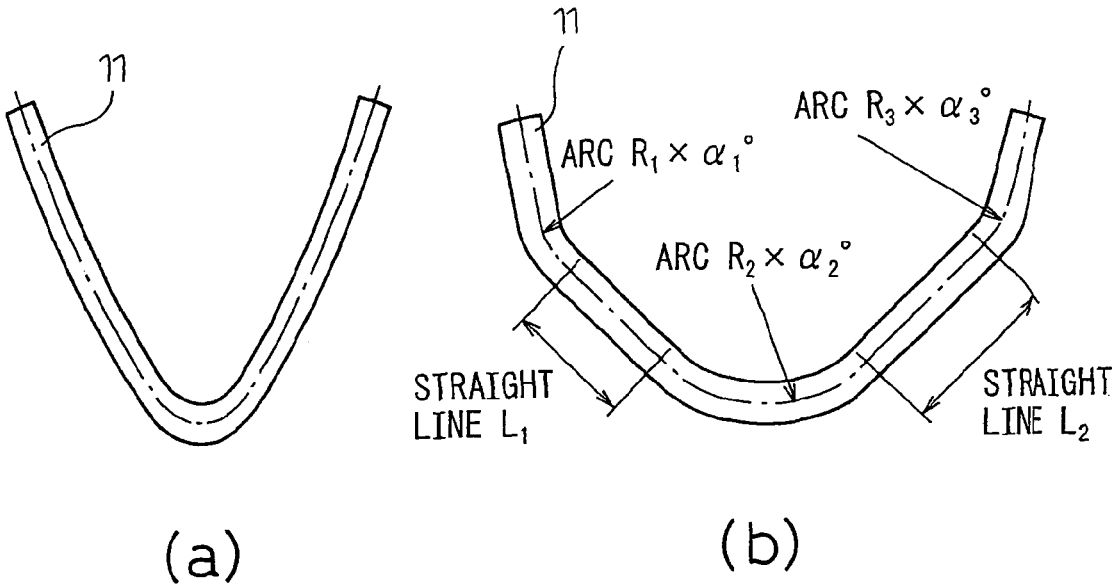
FIG. 10 gives views showing examples of bent shapes to which the present invention may be applied, wherein (a) shows a parabolic shape and (b) shows a combination of curved lines and straight lines.

The shape for bending the circular tube 11 need not be a circular arc shape. It may also be a parabolic shape as shown in (a) of FIG. 10. In addition, the present invention may also be applied to hyperbolic or sinusoidal shapes. Further, as in (b) of the figure, it may also be a shape combining these curved lines and straight lines.

Figure 11:
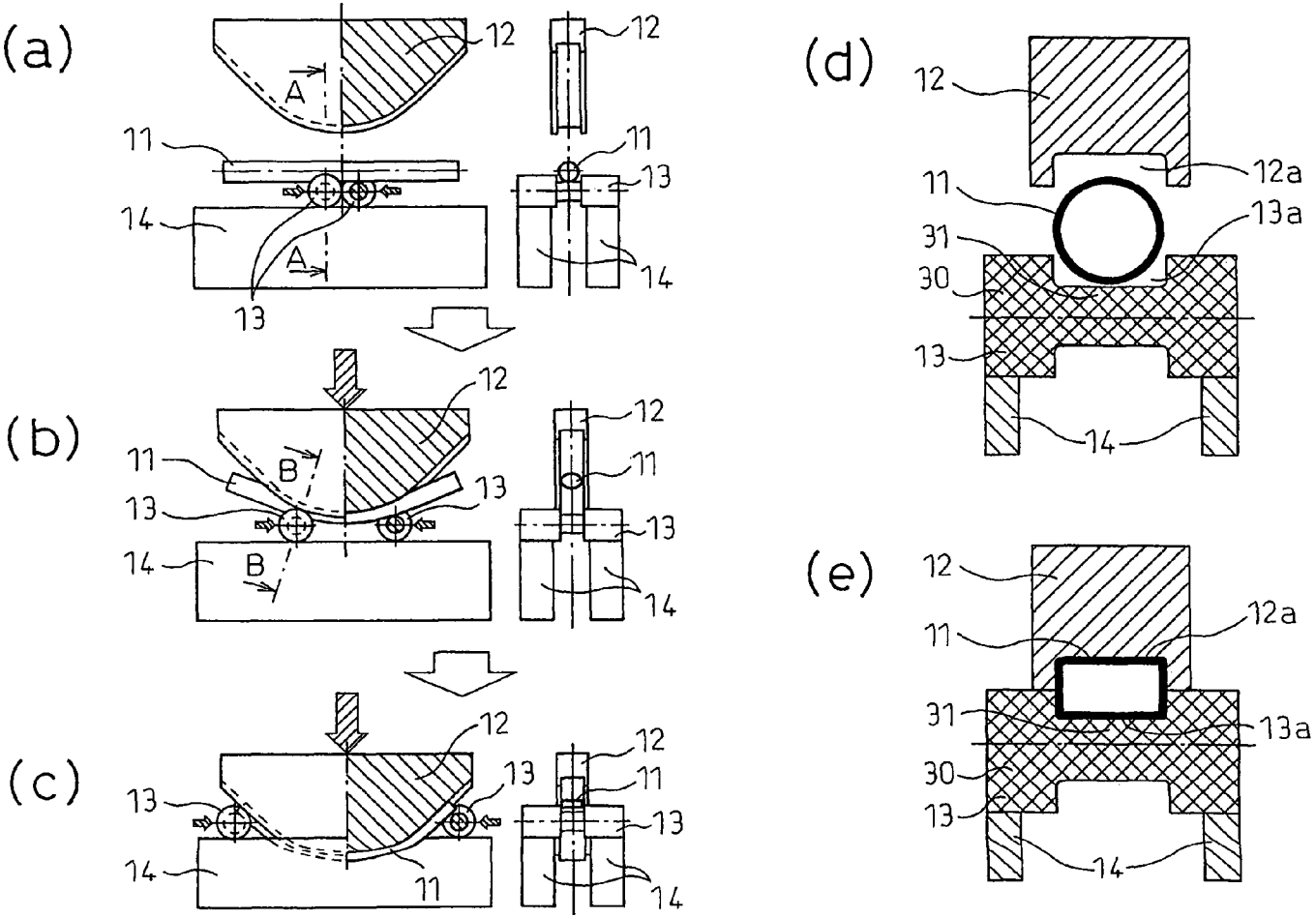
FIG. 11 gives views explaining the case of bending a circular cross-section tube material while deforming it to a rectangular cross-section in the present invention, wherein (a) to (c) are front views including partial cross-sectional views and side views showing the order of the bending method, (d) is an A-A cross-sectional view of (a), and (e) is a B-B cross-sectional view of (b).

Further, the cross-sectional shape of the tube material 11 and the cross-sectional shapes of the grooves 12*a*, 13*a* of the punch 12 or the center parts 31 of the rolls 13 do not have to be the same. For example, as shown in FIG. 11, the cross-section of the tube material 11 may be circular and the shapes of the grooves 12*a*, 13*a* of the punch 12 or the center parts 31 of the rolls 13, 13 may be made rectangular. If working the material by such a combination, it is possible to bend the entire material while changing the cross-sectional shape of the tube material 11 from a circular to a rectangular cross-section. Originally, when bending a tube material 11 of a rectangular cross-section, cross-sectional deformation, buckling, and other problems occur easily, but, as described above, if performing the cross-sectional deformation and bending simultaneously, the cross-sectional accuracy after the processing is also high and buckling does not easily occur. Further, this also leads to a reduction of steps and a reduction of the number of dies, so is also advantageous cost wise.

Figure 12:
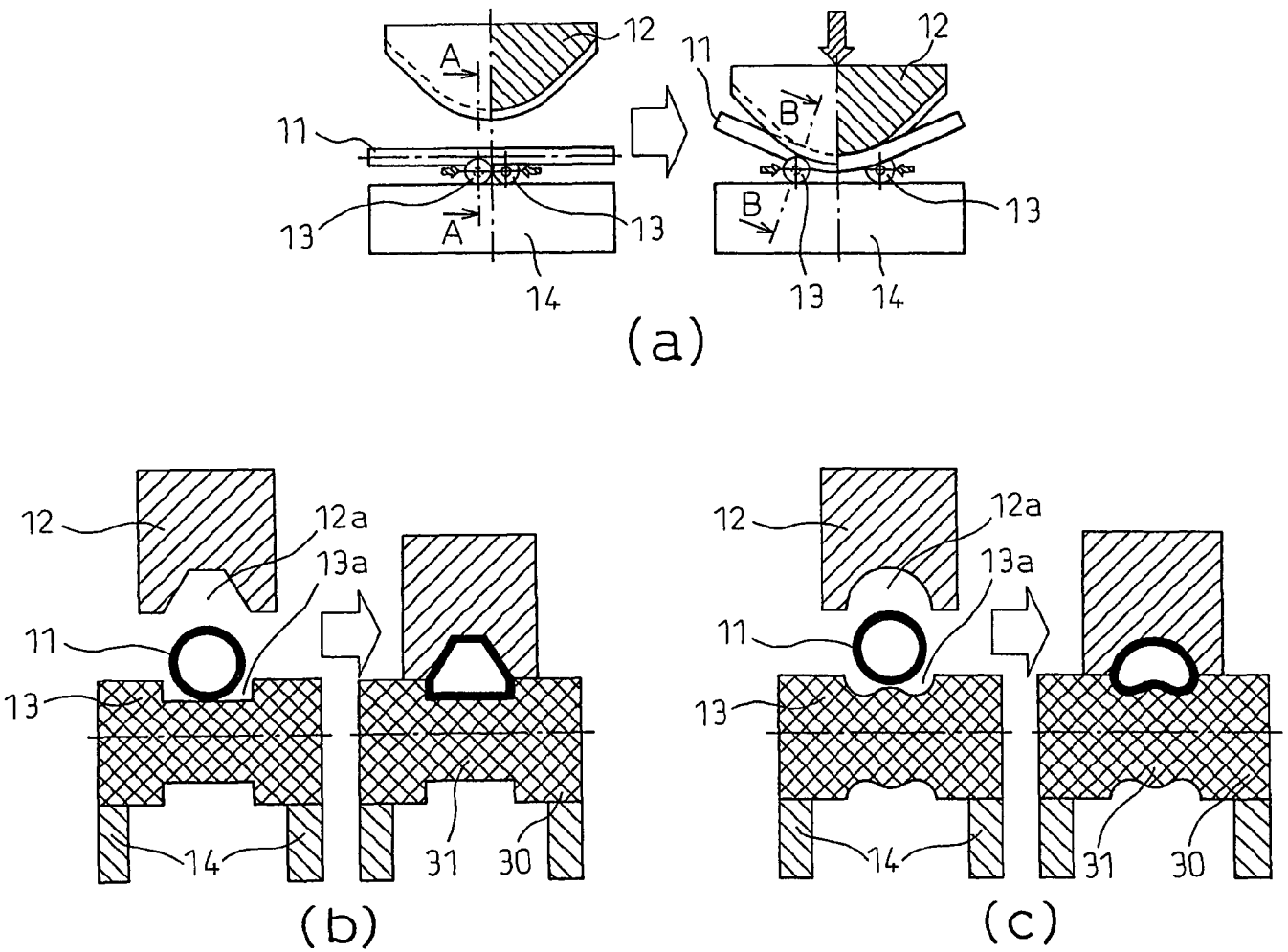
FIG. 12 gives views explaining examples of the groove shapes of the punch and the rolls in the case of changing the cross-sectional shape along with the bending and the changes in the cross-sectional shape due to the bending, wherein (a) gives front views including partial cross-sectional views showing the change before and after the bending, (b) gives cross-sectional views showing the shape of the A-A cross-section (before processing) and the shape of B-B cross-section (after processing) when changing into a trapezoidal cross-sectional shape and (c) gives cross-sectional views showing the shape of A-A cross-section (before processing) and the shape of the B-B cross-section (after processing) in (a) when changing into a flat disk cross-sectional shape.

Note that the shapes of the grooves 12*a*, 13*a* of the punch 12 and the center parts 31 of the rolls 13, 13 may be, in addition to rectangular shapes, as shown in FIG. 12, polygonal shapes or shapes of combinations of curved lines, but to enable the tube material 11 to be initially inserted, the widths of the grooves 12*a*, 13*a* must be made the width of the tube material 11 or more. Further, the total length of the circumferences of the grooves 12*a*, 13*a* of the punch 12 and the center parts 31 of the rolls 13 is preferably about the same extent as the circumference of the tube material 11, but some difference in size is allowable. However, if the circumferences of the grooves 12*a*, 13*a* are excessively large compared with the circumference of the tube material 11, the precision of the cross-sectional shape after bending will become poor, while conversely if it is excessively small, there is the possibility of wrinkles occurring.

Figure 13:
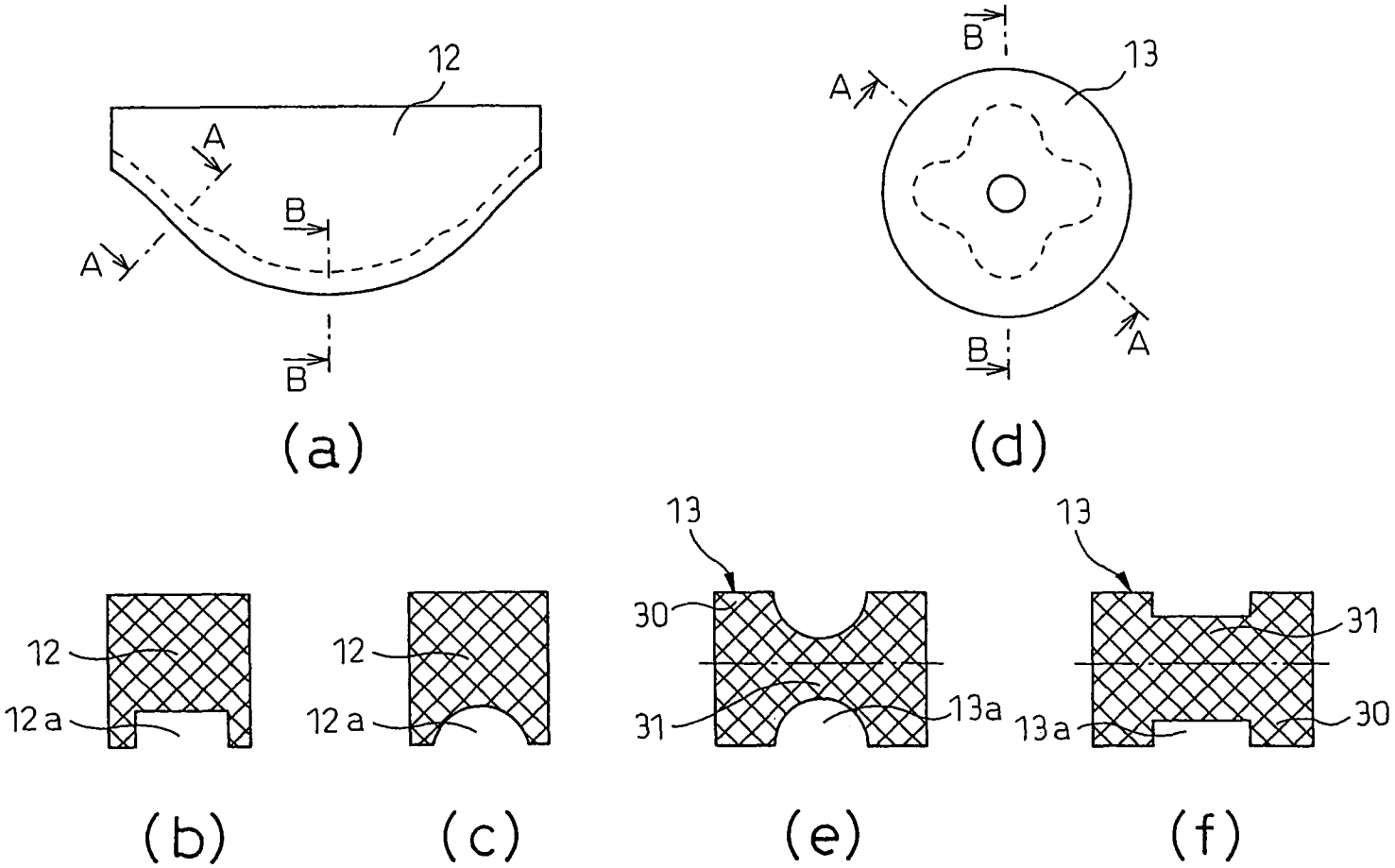
FIG. 13 gives views showing examples where the groove cross-sectional shapes of the punch and the rolls change in the present invention, wherein (a) is a front view showing an example where the groove cross-sectional shape of the punch changes in the longitudinal direction, (b) is an A-A cross-sectional view of (a), (c) is a B-B cross-sectional view of (a), further, (d) is a front view showing an example where the roll groove shape cross-section changes in the circumferential direction, (e) is an A-A cross-sectional view of (d), and (f) is a B-B cross-sectional view of (d).

Further, the cross-sectional shapes of the grooves 12*a*, 13*a* need not be uniform in the longitudinal direction. For example, as shown in (a) to (c) of FIG. 13, if making the cross-section of the groove 12*a* of the punch 12 change in the longitudinal direction, the tube material 11 will be deformed to a cross-sectional shape where the two ends are square and the other parts are circular while being simultaneously bent. Further, as shown in (d) to (f) of the same figure, the cross-sections of the grooves 13*a* of the center parts 31 of the rolls 13 may be repeatedly changed in the circumferential direction to a circular cross-section and square cross-section. However, as stated above as well, the total of the circumferences of the groove 12*a* of the punch 12 and the grooves 13*a* of the center parts 31 of the rolls 13 is preferably about the same extent as the circumference of the tube material 11, so it is sufficient to design the total of the circumferences of the groove 12*a* of the punch 12 and the grooves 13*a* of the center parts 31 of the rolls 13 to become uniform.

Figure 14:
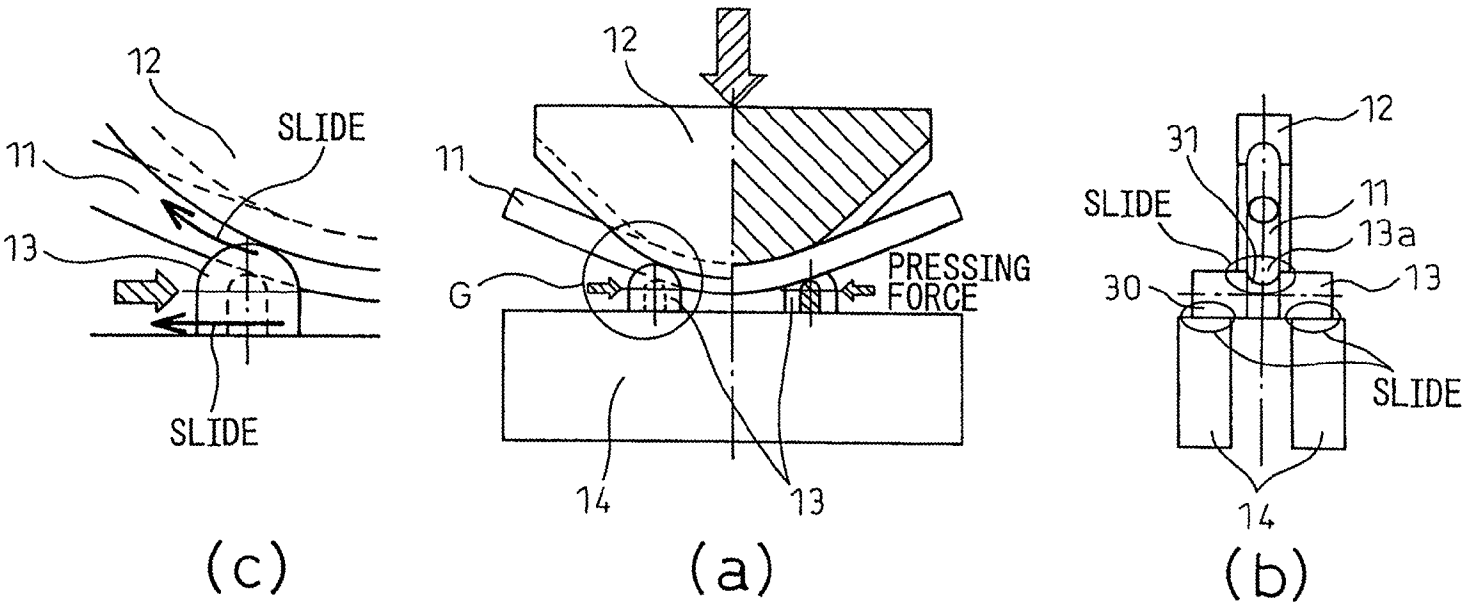
FIG. 14 gives views explaining the case where the rolls slide with respect to the punch and with respect to the frame in the present invention, where (a) is a front view including a partial cross-sectional view showing a state of bending, (b) is a side view showing a state of bending, and (c) is an enlarged view of a G part of (a).

Next, the rotation of the rolls 13 will be explained. FIG. 14 shows the case where the rolls 13 do not rotate with respect to the frame 14 and with respect to the punch 12, but slide along the top surface of the frame 14. To obtain this action, the bottom surfaces of the end parts 30 of the rolls 13 contacting the frame 14 are designed to be flat surfaces, while the top parts of the roll end parts 30 contacting the punch 12 form semicircular shapes. Note that the grooves 13*a* of the center parts 31 of the rolls 13 have cross-sections which are semicircular. As the advantages in this case, there are the point that the structures of the rolls 13, 13 becomes simple, the point that the tube material 11 is subjected to a frictional resistance during bending and is bent while being pulled in the longitudinal direction, so buckling will not easily occur, etc. On the one hand, as a drawback, there is the point that the frictional resistance is large, so the rolls 13, 13 become more difficult to move.

Figure 15:
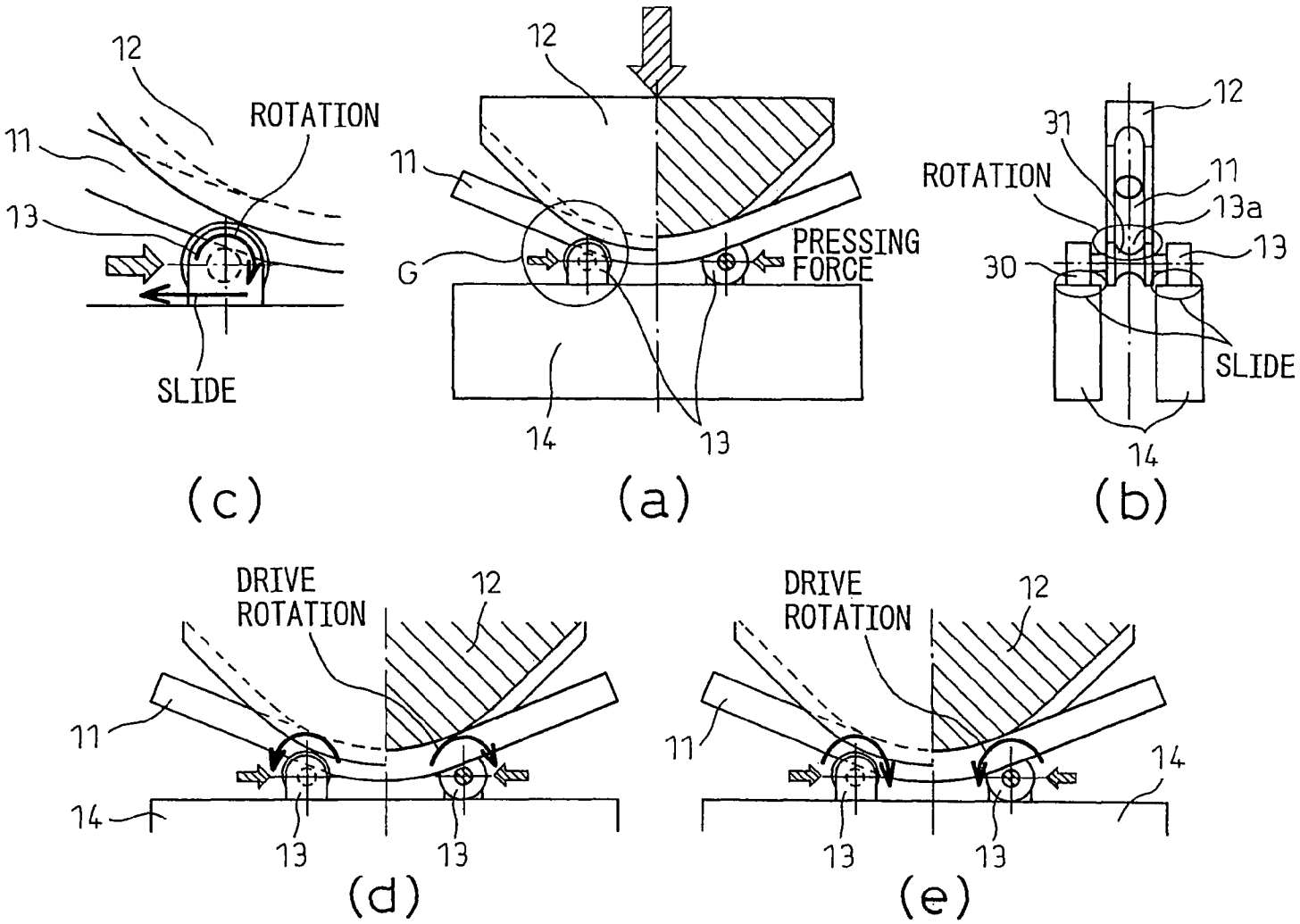
FIG. 15 gives views explaining the case where the rolls rotate with respect to the punch and slide with respect to the frame in the present invention, wherein (a) is a front view including a partial cross-sectional view showing the state of bending, (b) is a side view showing the state of bending, (c) is an enlarged view of a G part of (a), (d) shows the case where the rolls rotate outward from each other in (a), and (e) shows the case where the rolls rotate inward from each other in (a).

On the one hand, FIG. 15 is an example where the rolls 13 slide with respect to the frame 14 without rotating and move with respect to the punch 12 while rotating. In order to obtain this action, the bottom surfaces of the end parts 30 of the rolls 13 contacting the frame 14 are designed to be flat surfaces. Further, the center parts 31 of the rolls 13 contacting with the punch 12 form hourglass-shaped circular shapes and are designed to be able to rotate independently from the roll end parts 30. Note that the grooves 13*a* of the center parts 31 of the rolls 13 have cross-sections which are semicircular. In this case, the rolls 13 can move with respect to the punch 12 with little resistance, so this is particularly effective for the case as shown in FIG. 11 of bending the tube material 11 while changing the cross-sectional shape. Further, as shown in (d) to (f) of FIG. 13, it becomes possible to change the shapes of the grooves 13*a* of the center parts 31 of the rolls 13 in the longitudinal direction to make the cross-sectional shape of the tube material 11 change at the outer side of the bending while bending the material. However, the structures of the rolls 13 become complicated, and, further, the force pulling the tube material 11 declines. Consequently, as shown in (d) of FIG. 15, if driving the rolls 13, 13 to rotate outward from each other (that is, in directions making the tube material 11 advance toward the tube ends), it is possible to increase the force pulling the tube material 11 and there is an effect in suppressing buckling during bending. Conversely, as in (e) of FIG. 15, if driving the rolls 13, 13 to rotate inward toward each other (that is, in directions making the tube material 11 advance toward the opposite direction from the tube ends), the movement resistance of the rolls 13 can be reduced. This is particularly effective in the case where the contact angles of the contact surfaces of the punch 12 and the rolls 13 are close to horizontal. It becomes possible to smoothly move the rolls 13 to the outside in the initial stage of the bending.

Figure 16:
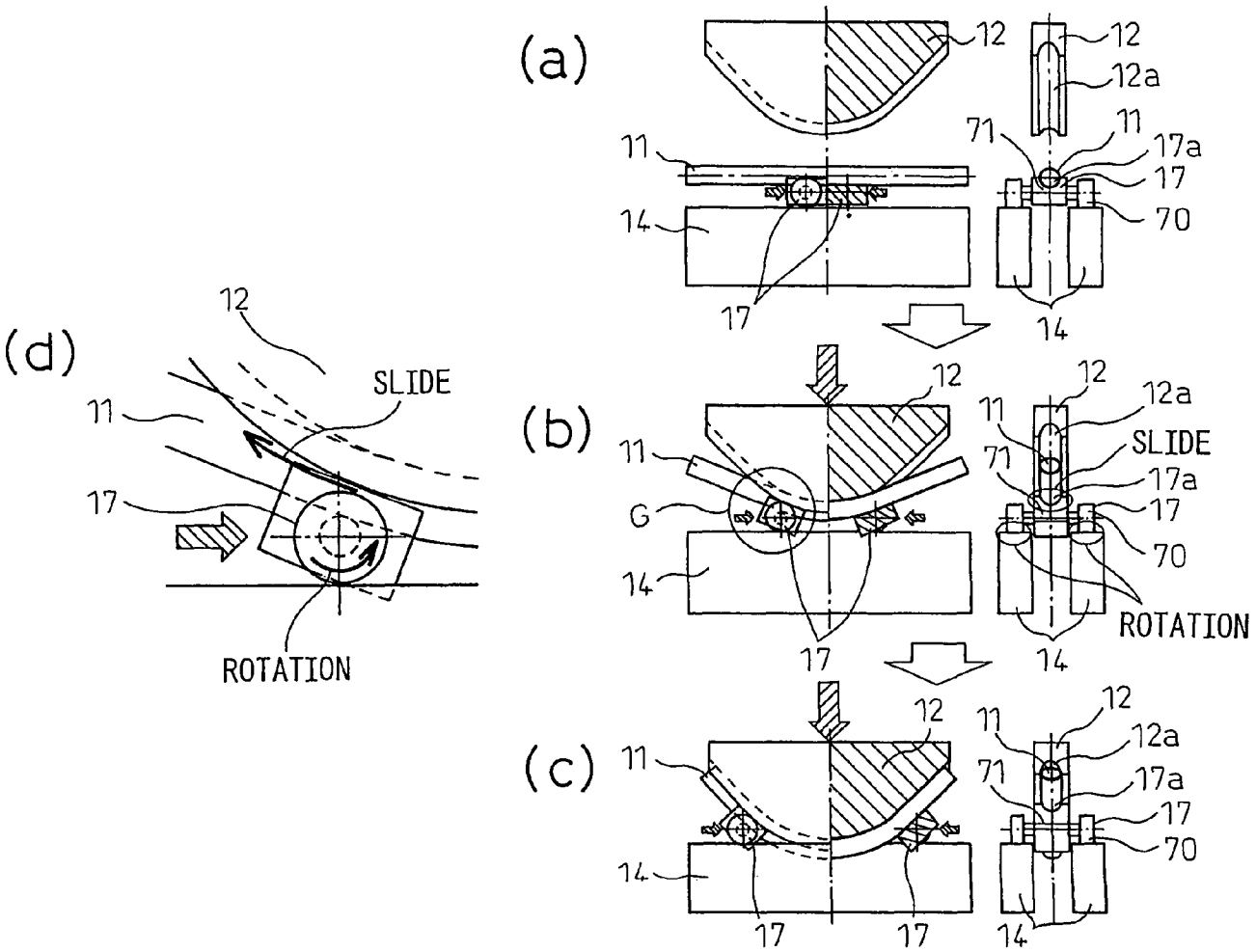
FIG. 16 gives views explaining the case where the rolls slide with respect to the punch and rotate with respect to the frame in the present invention, wherein (a) to (c) are front views including partial cross-sectional views and side views showing the order of the bending method, and (d) is an enlarged view of a G part of (a).

As an example of rolls which rotate on the frame 14 and slide with respect to the punch 12, rolls 17 with locations contacting the punch 12 flat in shape as shown in FIG. 16 may be considered. To obtain this action, the end parts 70 of the rolls 17 contacting the frame 14 are designed to be columnar shaped. The center parts 71 of the rolls 17 contacting the punch 12 for block shaped outer shapes. Further, the roll end parts 70 are designed to freely rotate independently from the roll center parts 71. The roll center parts 71 are designed to freely track the angle of the shape of the groove 12*a* of the punch 12. Note that the grooves 17*a* of the center parts 71 of the rolls 17 have cross-sections of semicircular shapes. In this case, it is possible to crush the tube material 11 over a wide surface. This is effective for prevention of local crushing etc. Further, the center part of the tube material 11 which cannot be crushed in the initial stage of bending with circular rolls 13 can also be crushed if using such flat rolls 17. Further, these flat rolls 17, 17 were taken up as an example of, as shown in FIG. 16, sliding with respect to the punch 12 and rotating with respect to the frame 14, but the present invention is also applicable to the case as shown in FIG. 15 of sliding with respect to the frame 14.

Figure 17:
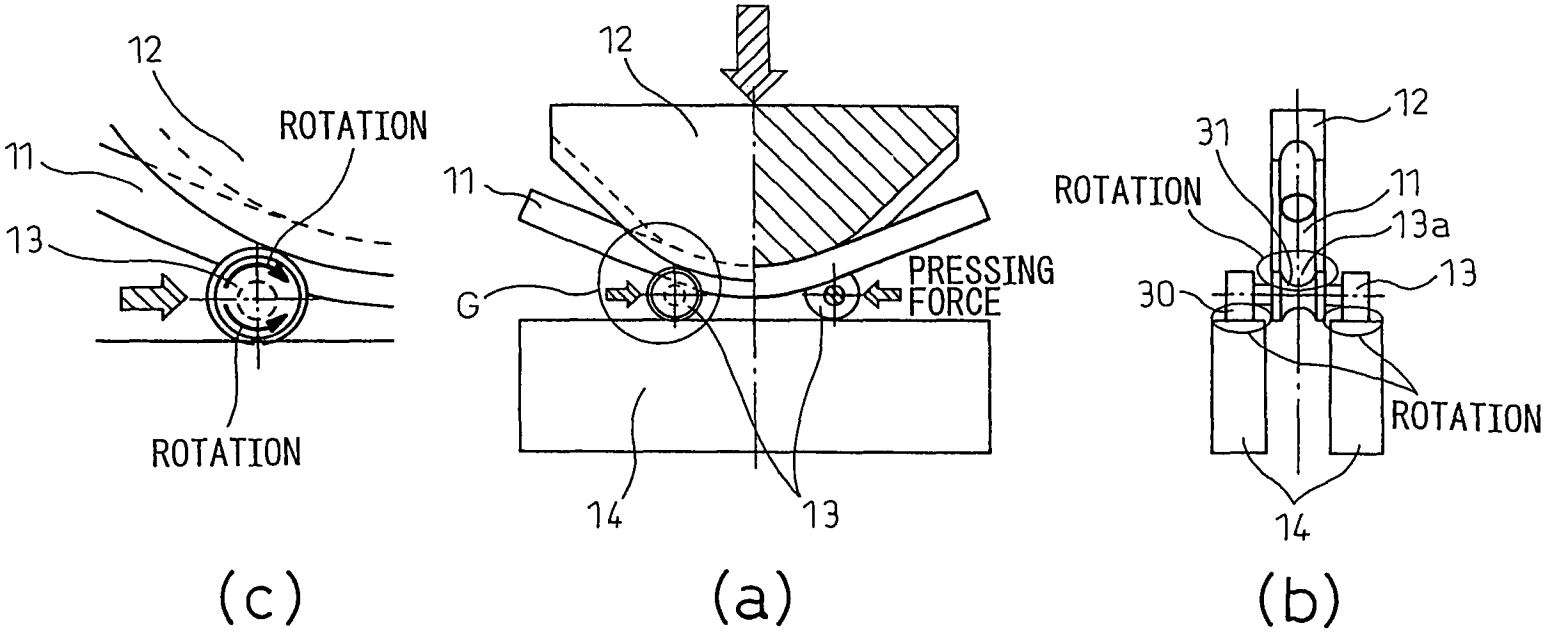
FIG. 17 gives views explaining the case where the rolls rotate with respect to the punch and with respect to the frame in the present invention, wherein (a) is a front view including a partial cross-sectional view showing the state of bending, (b) is a side view showing the state of bending, and (c) is an enlarged view of a G part of (a).

Finally, FIG. 17 is an example where the rolls 13, 13 rotate with respect to the frame 14 and with respect to the punch 12. In order to obtain this action, the end parts 30 of the rolls 13 contacting the frame 14 are designed to be columnar shapes. The center parts 31 of the rolls 13 contacting the punch 12 form hourglass shaped circular shapes. The roll end parts 30 and the roll center parts 31 are designed to freely rotate independently. Note that the grooves 13*a* of the center parts 31 of the rolls 13 have cross-sections of semicircular shapes. The motion resistance of the rolls 13 becomes less than the example shown in FIG. 14 to FIG. 16. The movement becomes smooth, but the force pulling the tube material 11 in the longitudinal direction declines, so this is disadvantageous for buckling.

Figure 18:
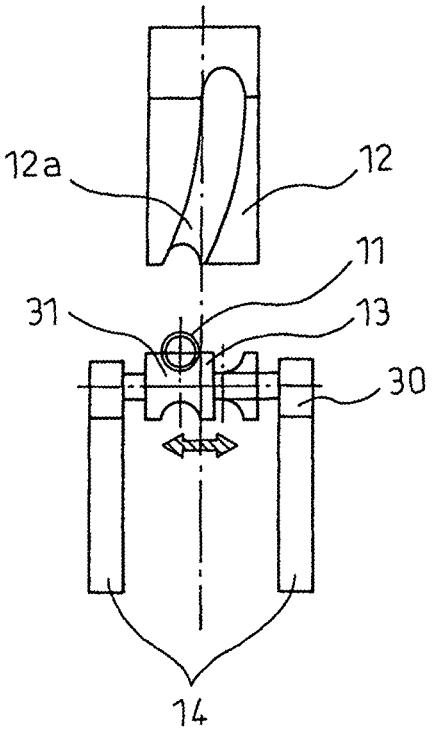
FIG. 18 is a view explaining a combination of rolls and a punch where the rolls are structured to be movable in the axial direction of the rolls and where bending into a three-dimensional shape is possible in the present invention.

Above, rotation of the rolls 13 was described. Next, movement of the rolls 13 in the axial direction will be described. As shown in FIG. 18, if changing the shape of the groove 12*a* of the punch 12 in the short direction to obtain a structure where the center parts 31 of the rolls 13 can move in the axial direction of the rolls 13 so as to track that shape, it is also possible to bend the tube material 11 into a three-dimensional shape.

Figure 19:
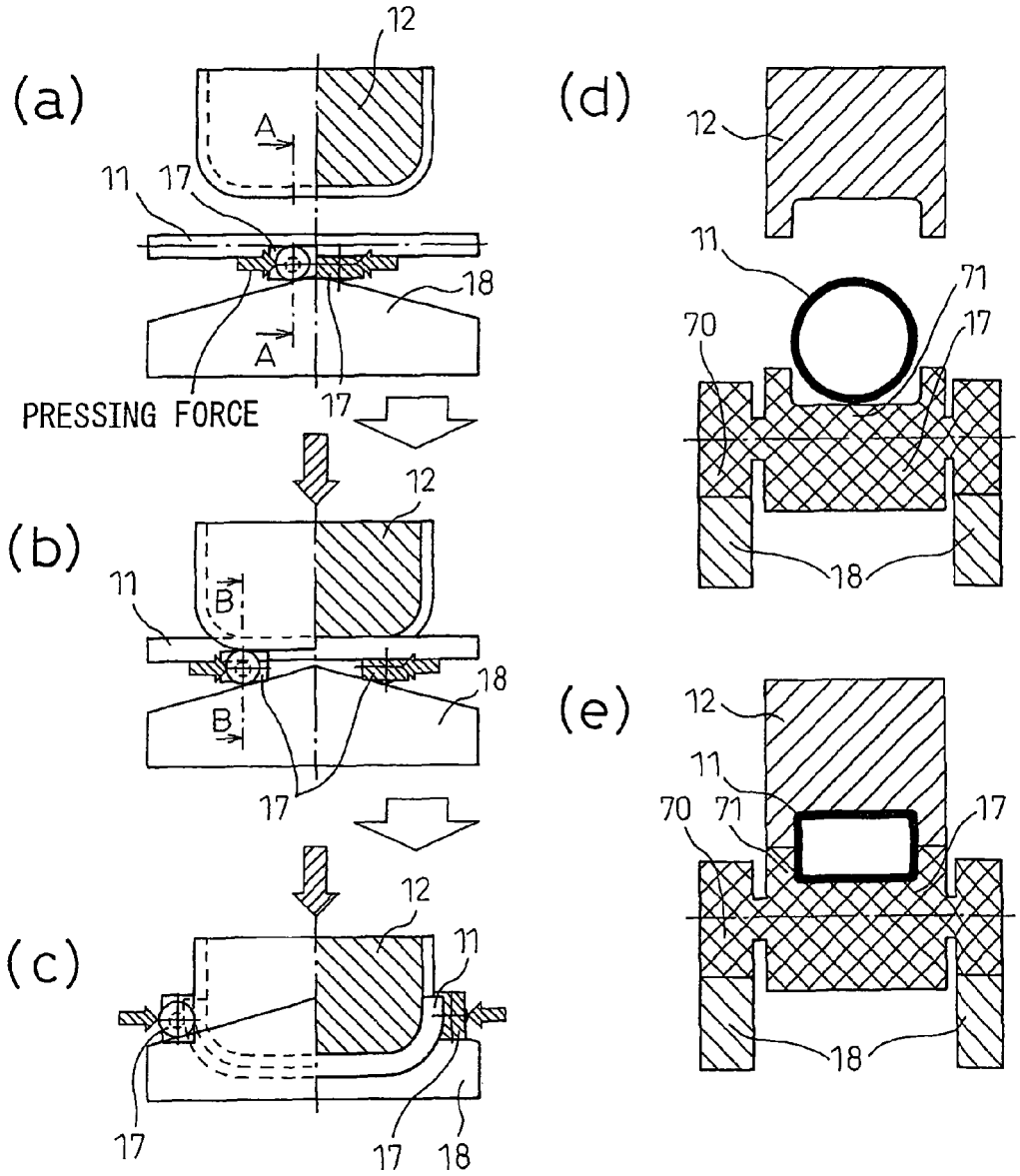
FIG. 19 gives views explaining the case where a top surface of the frame forms an acute angle with a direction of movement of the punch in the present invention, wherein (a) to (c) are front views including partial cross-sectional views showing the order of the bending method, (d) is an A-A cross-sectional view of (a), and (e) is a B-B cross-sectional view of (b).

Next, the shape of the frame 14 will be described. In the examples described so far, for example, as shown in FIG. 6, the surface of the frame 14 on which the rolls 13 moved was perpendicular in angle with respect to the direction of progression of the punch 12. However, in the case, as in the initial bending of (a) of the same figure, where the angle of the surface contacting the punch 12 and the rolls 13 is substantially perpendicular with respect to the direction of progression of the punch 12, it is difficult to use the progression of the punch 12 to make the rolls 13 move in the directions separating from each other. Therefore, as shown in FIG. 19, if using a frame 18 where the angle of the surface on which the rolls 17 move becomes an acute angle with respect to the direction of progression of the punch 12, the rolls 17 can move smoothly even in the initial stage of bending. Further, if using a frame 18 where the sliding surface of the rolls is inclined, the rolls 17 can move smoothly from the beginning even in the case of a punch 12 as shown in FIG. 19 where the center part is flat.

Examples of the present invention are shown below.

Example 1

Figure 20:
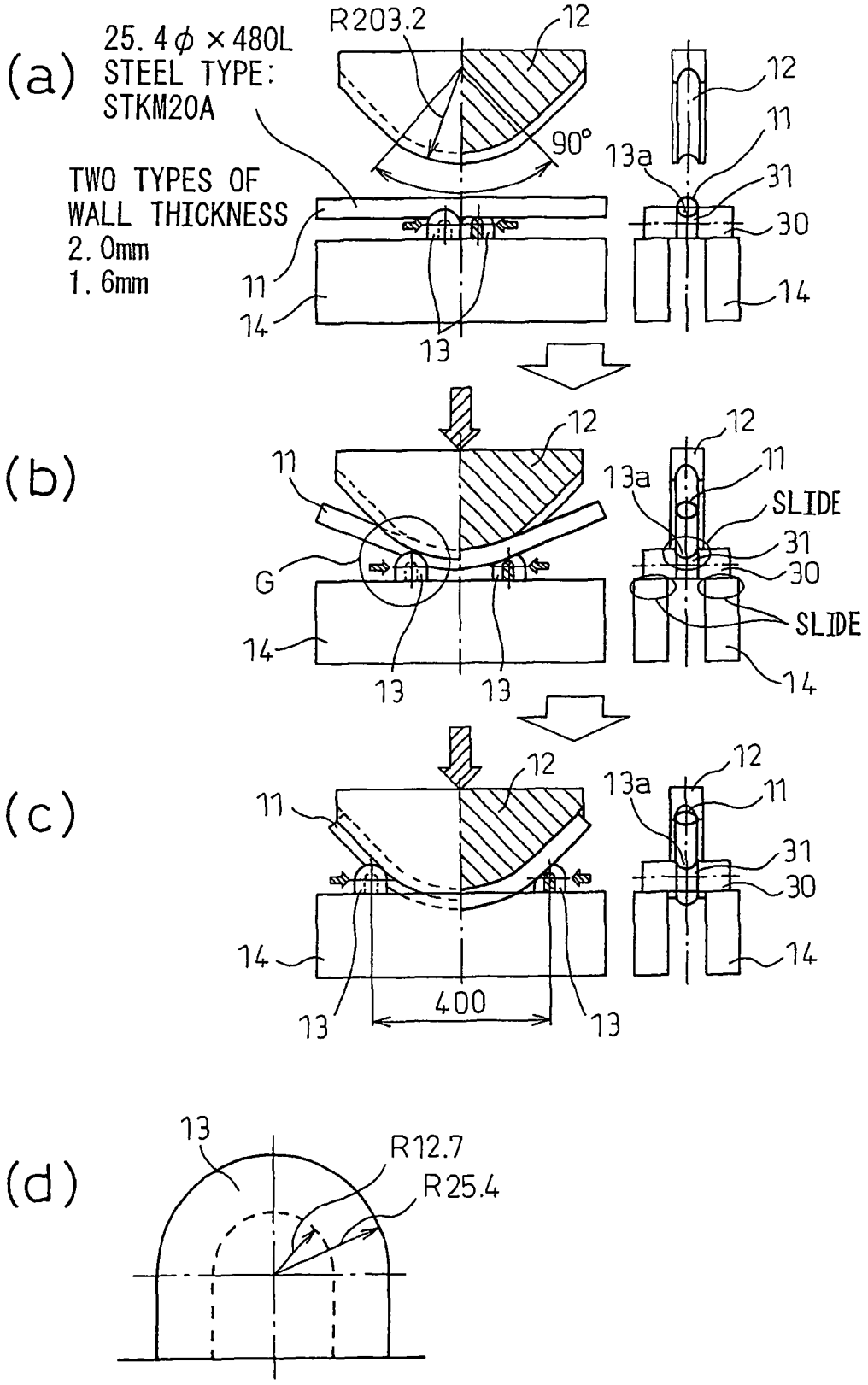
FIG. 20 gives views explaining Example 1 of the present invention, wherein (a) to (c) are front views including partial cross-sectional views and side views showing the order of the bending, and (d) is an enlarged view of a G part of (b).

For the tube material 11 of a circular tube, STKM20A of carbon steel tubes for mechanical structures of an outside diameter of 25.4 mm and a total length of 480 mm was used. The wall thicknesses t were made two types: 2.0 mm and 1.6 mm. At the steel tube, as shown in FIG. 20, the center of the tube material 11 was bent 90° to a circular arc shape of a bending radius of 203.2 mm (8 times the outside diameter). Note that the rolls 13, as shown in FIG. 14, were structured so as not to rotate, but to slide with respect to the frame 14 and with respect to the punch 12. The dimensions, as shown in the same figure, were made R=25.4 mm at the outer side and R=12.7 mm at the inner side (groove bottom). Namely, the bottom surfaces of the end parts 30 of the rolls 13 contacting the frame 14 are designed to be flat surfaces, while the top parts of the roll end parts 30 contacting the punch 12 form semicircular shapes. Further, the grooves 13*a* of the center parts 31 of the rolls 13 have cross-sections of semicircular shapes. The shapes of grooves 13*a* were made cross-sections of semicircular shapes of the same diameters as the outside diameter of the tube material 11 both at the punch 12 side and the roll 13 side. Further, as the final position, the punch 12 was pushed in until the distance between the centers of the two rolls 13, 13 became 400 mm.

Example 2

Figure 21:
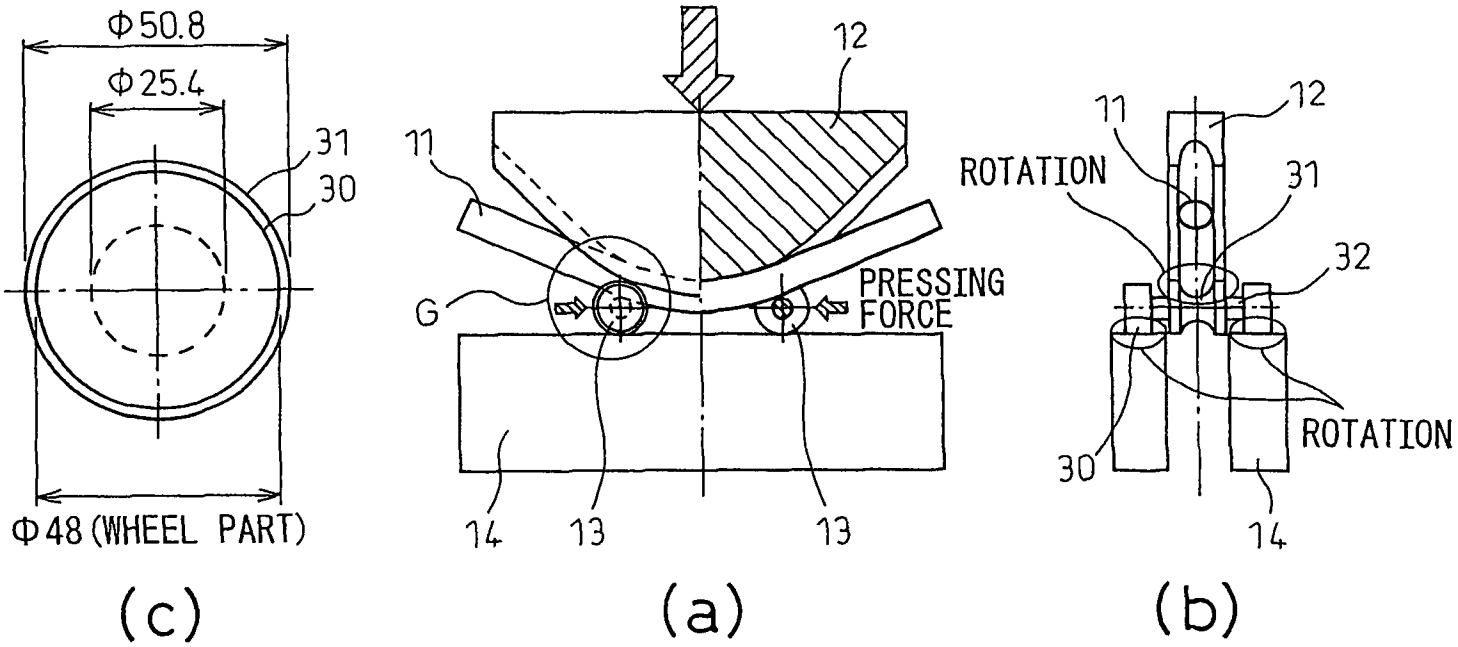
FIG. 21 gives views explaining Example 2 of the present invention, wherein (a) is a front view including partial cross-sectional view showing the state of bending, (b) is a side view showing the state of bending, and (c) is an enlarged view of a G part of (a).

The same tube material 11 as in Example 1 was used for bending under the same conditions. Only the structure of the rolls 13 was changed. The rolls 13, as shown in FIG. 21, are structured to be able to move over the frame 14 while circular wheels 30 (end parts 30 of the rolls) rotates. The semicircular cross-section hourglass-shaped roll center parts 31 can move with respect to the punch 12 as well while rotating. Note that the shafts 32 connecting with the wheel parts 30 on the frame 14 and hourglass-shaped roll center parts 31 contacting the punch 12 are structured fastened with the roll center parts 31, but can freely rotate with respect to the wheel parts 30. Further, the dimensions of the rolls 13 are an outside diameter of the wheel parts 30 of 48 mm, an outside diameter of the hourglass-shaped roll center parts 31 of 50.8 mm, and a distance between the grooves 13*a*, 13*a* of 25.4 mm.

Example 3

Figure 22:
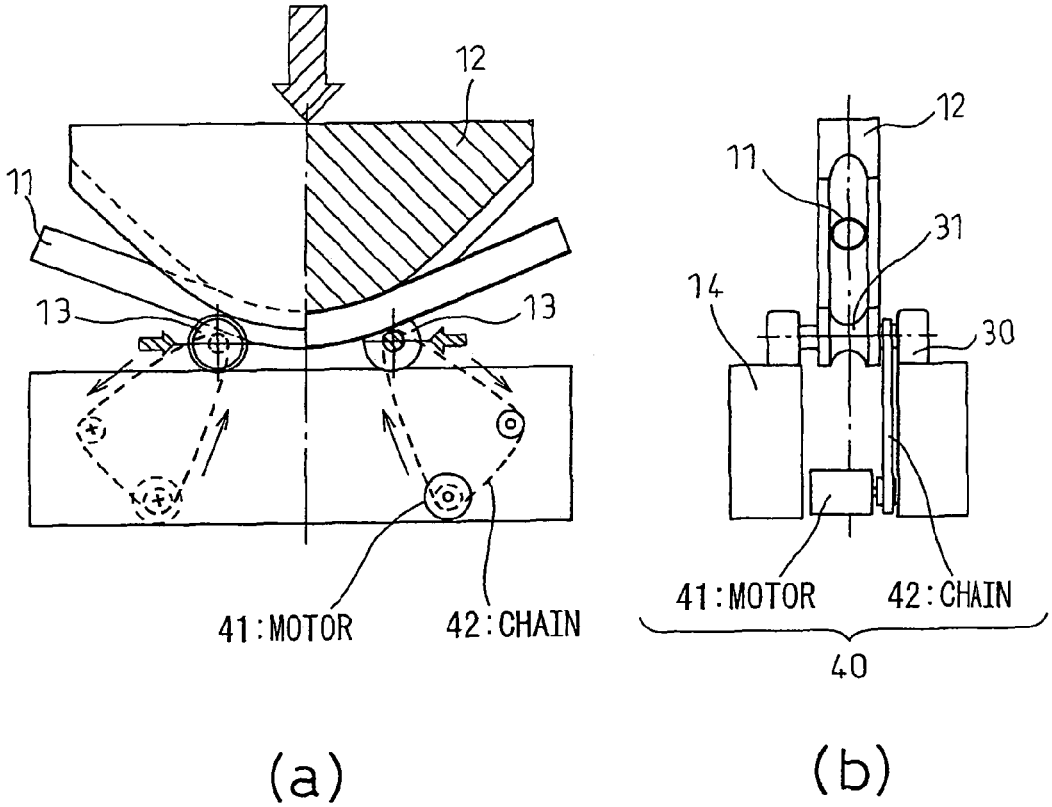
FIG. 22 gives views explaining Example 3 of the present invention, wherein (a) is a front view including partial cross-sectional view showing the state of bending and (b) is a side view showing the state of bending.

A tube material 11, punch 12, frame 14, and rolls 13 the same as with Example 2 were used for bending by pushing in the punch 12 until the same position as with Example 2. However, the rolls 13 were driven to bend the material while forcibly making it rotate. For driving the rolls 13, in this example, as shown in FIG. 22, driving means 40 for driving the rotation of the rolls 13 in a direction making the tube material 11 advance towards the tube ends were used. At the driving means 40, motors 41 and chains 42 which make the shafts 32 of the rolls 13 rotate were arranged to forcibly make the shafts 32 rotate via the chains 42 from the motors 41. Namely, the direction of the rotation was made the direction by which the two rolls 13, 13 head toward the outsides from each other.

Example 4

Figure 23:
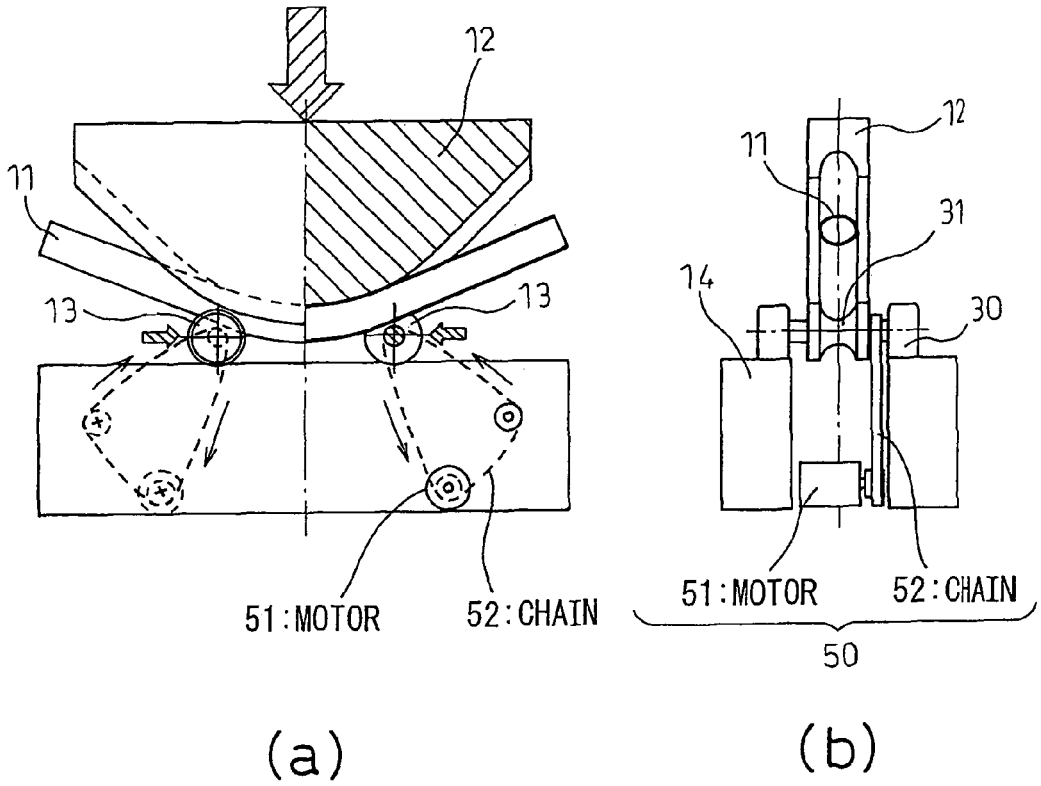
FIG. 23 gives views explaining Example 4 of the present invention, wherein (a) is a front view including partial cross-sectional view showing the state of bending and (b) is a side view showing the state of bending.

Only the drive directions of the rolls 13 were reversed from Example 3. Namely, driving means 50 for driving the rotation of the rolls 13 in directions making the tube material 11 advance towards the opposite directions from the tube ends were used. At the driving means 50, motors 51 and chains 52 making the shafts 32 of the rolls 13 rotate were arranged to make the two rolls 13, 13 rotate in directions whereby they head toward the insides with each other for the bending operation (see FIG. 23).

The presence/absence of any buckling at the inner side of bending and the results of the pushing load when bending the materials in Examples 1 to 4 above are shown in Table 1. For comparison, the results by a conventional three-point bending method are shown together. Note that for the support points of the three-point bending, support points of the same shape as the rolls 13 of Example 1 were used. The distance between the support points was set to the same 400 mm as the final positions of Examples 1 to 4.

As a result, a thickness 2.0 t material which buckled with bending by the conventional three-point bending could be bent without buckling by the method of the present invention in each of Examples 1 to 4. However, when it comes to a further thinner material of 1.6 t, the material did not buckle under the conditions of Example 1 where the rolls 13 slide with respect to the punch 12 and the frame 14, but buckled under the conditions of Example 2 where the rolls 13 rotate. Therefore, as shown in Example 3, if driving the rolls 13 to rotate toward the outsides from each other, the tube material 11 was subjected to a pulling force in the tube axial direction and buckling could be prevented.

However, under conditions making the rolls 13 slide or conditions making them rotate toward the outsides from each other, the pushing load of the punch 12 increases, so this is disadvantageous from the viewpoint of keeping the capacity of the facilities as small as possible. As opposed to this, as shown in Example 4, if making the rolls 13 rotate inward with respect to each other, the pushing load can be reduced. In order to bend thick materials where buckling does not become a problem by a small force, the method of Example 4 becomes effective.

TABLE 1

| | | 3-point bending (Comp. Ex) | Ex. 1 | Ex. 2 | Ex. 3 | Ex. 4 |
|---|---|---|---|---|---|---|
| Movement of rolls | With respect to punch | No contact | Sliding | Rotation | Rotation | Rotation |
| | With respect to frame | Fasten | Sliding | Rotation | Rotation | Rotation |
| Drive of rolls | | Fasten | Fasten | Free | Rotation to outer side | Rotation to inner side |
| Bending of 2.0 t material | Buckling of inner side of bending | Buckling | None | None | None | None |
| | Pressing load (kN) | 6.7 | 9.4 | 7.5 | 8.9 | 7.1 |
| Bending of 1.6 t material | Buckling of inner side of bending | Buckling | None | Buckling | None | Buckling |
| | Pressing load (kN) | 5.7 | 7.9 | 6.4 | 7.5 | 6.1 |

Example 5

Figure 24:
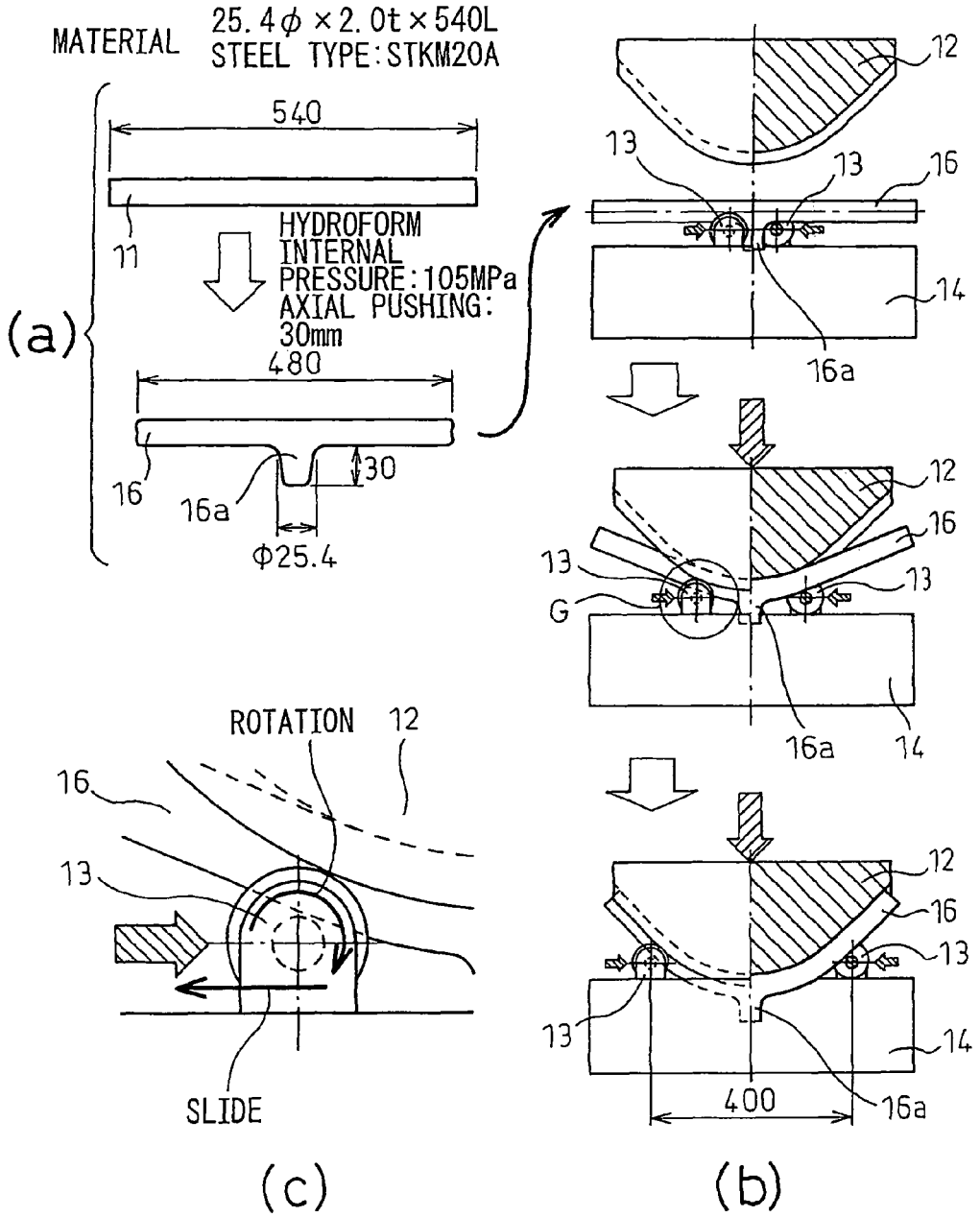
FIG. 24 gives view explaining Example 5 of the present invention, wherein (a) is a figure showing a hydroforming method of a tube material, (b) is a front view including a partial cross-sectional view showing the order of bending a hydroformed tube material, and (c) is an enlarged view of a G part in (b).

An example of application, as the tube material 11 to be bent, of not a simple straight tube, but a worked part 16 obtained by primary processing by hydroforming is shown in FIG. 24. First, a material of an outside diameter of 25.4 mm, a wall thickness of 2.0 mm, a total length of 540 mm, and a steel type of STKM20A (tube material 11 the same as the thickness 2.0 t material used in Examples 1 to 4, but with a length of 60 mm) was shaped by hydroforming to a shape with a burled part 16*a* of a height of 30 mm sticking out. As the hydroforming conditions at that time, the internal pressure was made 105 MPa and axial pushing was made 30 mm each from both ends. Consequently, the length after the hydroforming became 480 mm. The hydroformed part 16 was bent with the burled part 16*a* left at the bottom. The shapes of the punch 12 and the rolls 13 and the final distance between the rolls 13, 13 at that time were made the same as with the case of Examples 1 to 4, but the movement conditions of the rolls 13 were made the conditions of rotation with respect to the punch 12 and sliding with respect to the frame 14. As a result of the bending, no buckling or other shaping defects were seen. A shaped product of a good shape could be obtained.

Example 6

Figure 25:
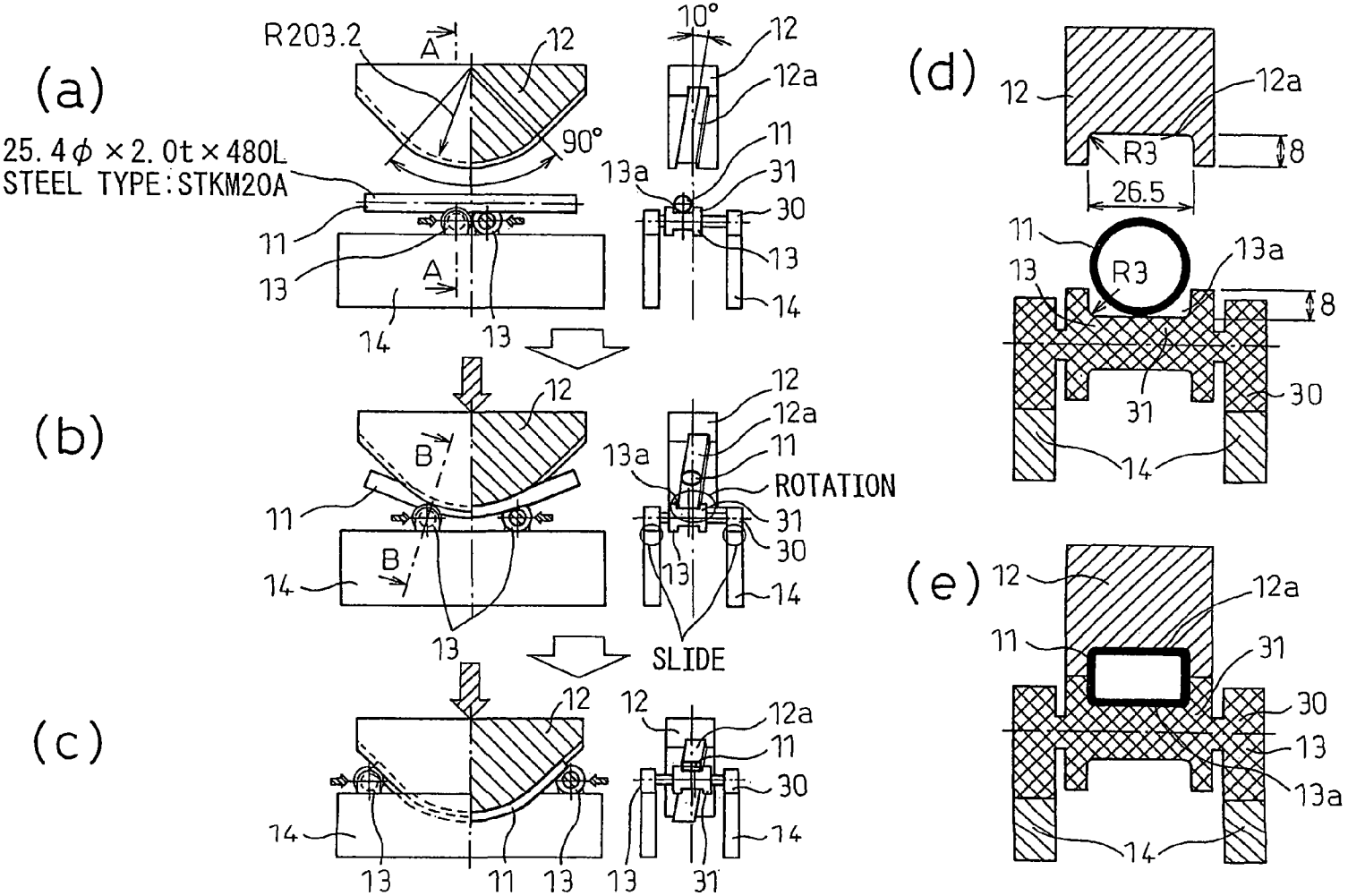
FIG. 25 gives views explaining Example 6 of the present invention, wherein (a) to (c) are front views including partial cross-sectional views showing the order of the bending method, (d) is an A-A cross-sectional view of (a), and (e) is a B-B cross-sectional view of (b).

FIG. 25 is the example of using a tube material 11 the same as the thickness 2.0 t material used in Examples 1 to 4 and making the shape of the groove 12*a* of the punch 12 and the shapes of the grooves 13*a* of the center parts 31 of the rolls 13 rectangular cross-sections. The rectangular shapes were designed as a horizontal width of 26.5 mm, a height of 8+8=16 mm, and a corner chamfering=3 mm. As the circumference, the tube material circumference was 79.80 mm, while the total circumference of the inner surfaces of the grooves 12*a*, 13*a* of the punch 12 and the rolls 13 became 79.85 mm or was set to almost the same circumference. The position of the groove 12*a* of the punch 12 in the axial direction was designed to be not on plane parallel to the pushing direction, but a position passing through the plane inclined 100. In order to enable the rolls 13 to move in the axial direction, the roll end parts 30 were made columnar shapes. In order to enable them to move, during the bending, along the position of the groove 12*a* of the punch 12, the roll center parts 31 were made movable in the axial directions of the rolls 13. The punch was pressed down until the rolls 13, 13 finally reached the positions of the tube ends so as to deform the cross-section over the entire length. The rest of the conditions are the same as with Example 2. As a result of bending with the above apparatus and working conditions, it was possible to obtain a shaped article with a rectangular cross-section bent in three-dimensions from a circular cross-section straight tube by a single bending operation.

Example 7

Figure 26:
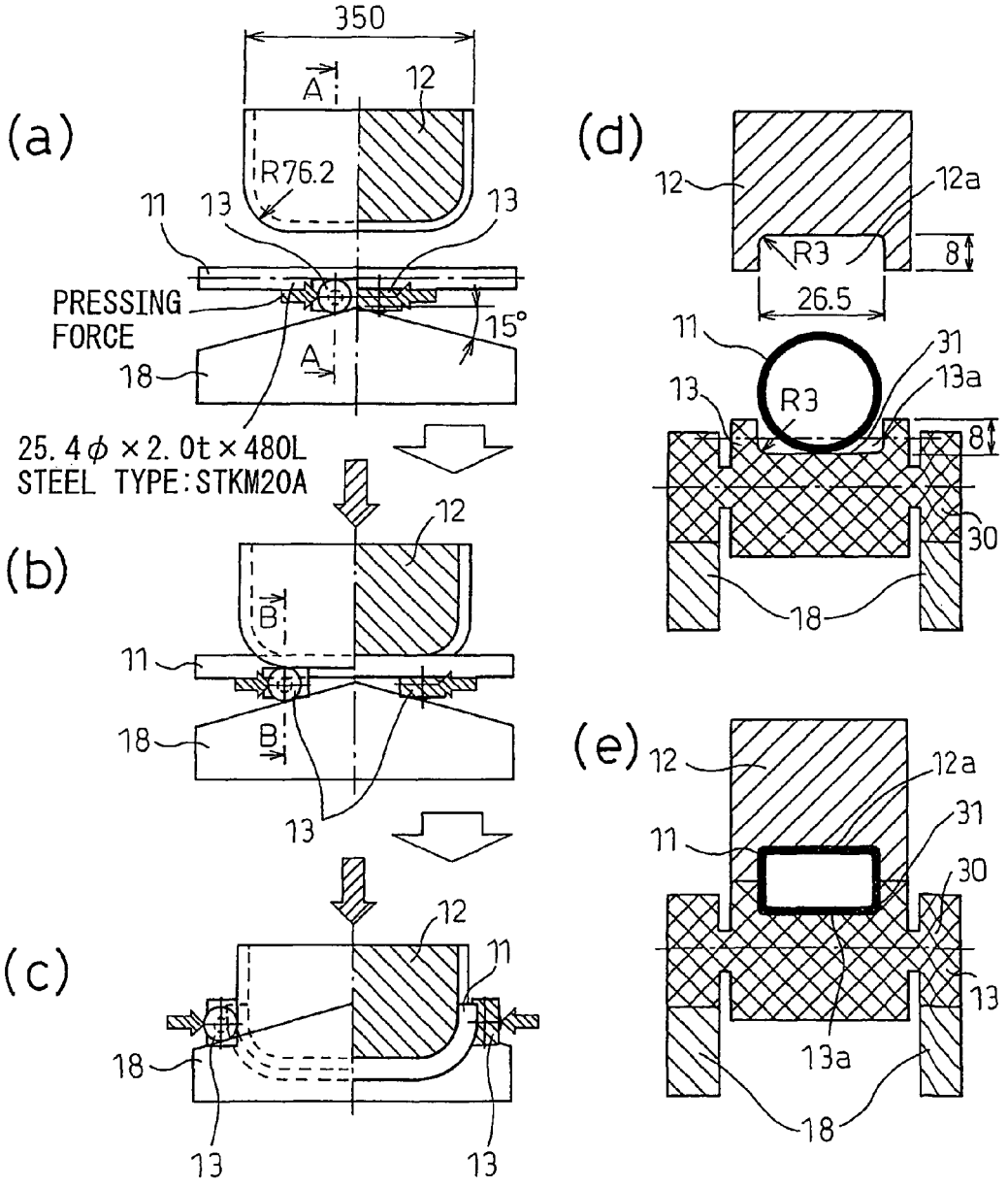
FIG. 26 is a view explaining Example 7 of the present invention, wherein (a) to (c) are front views including partial cross-sectional views showing the order of the bending method, (d) is an A-A cross-sectional view of (a), and (e) is a B-B cross-sectional view of (b).

FIG. 26 is an example of bending by a punch 12 with a flat shaped center part. Furthermore, this is an example of making the cross-section of the tube material 11 including a flat portion deform into a rectangular shape, so the rolls 13, 13 have to start moving from the center position. Consequently, the surfaces of the frame 18 where the end parts 30 of the rolls 13, 13 move are made to form acute angles with the direction of progression of the punch 12 (the downward direction in FIG. 26) by making the surfaces of the frame 18, as shown in the figure, slant 15° downward with respect to the horizontal plane so as to enable the rolls 13, 13 to easily move to the outsides from each other. Further, since the cross-sections of the roll center parts 31 also form rectangular shapes, the cross-sectional shapes of the roll center parts 31 were made rectangular shapes, not circular shapes. Further, the roll center parts 31 and the roll end parts 30 are designed to independently 15' rotate freely. The roll center parts 31 are designed to freely track the angle formed by the shape of the groove 12*a* of the punch 12. Note that for the tube material 11, a tube material 11 the same as the thickness 2.0 t material used in Examples 1 to 4 was used. The punch was pushed down until the rolls 13, 13 finally reached the positions of the tube ends to cause the cross-section to deform over the entire length. As a result of the bending, it is possible to obtain a shaped article with a rectangular cross-section and two bent ends.

Example 8

Figure 27:
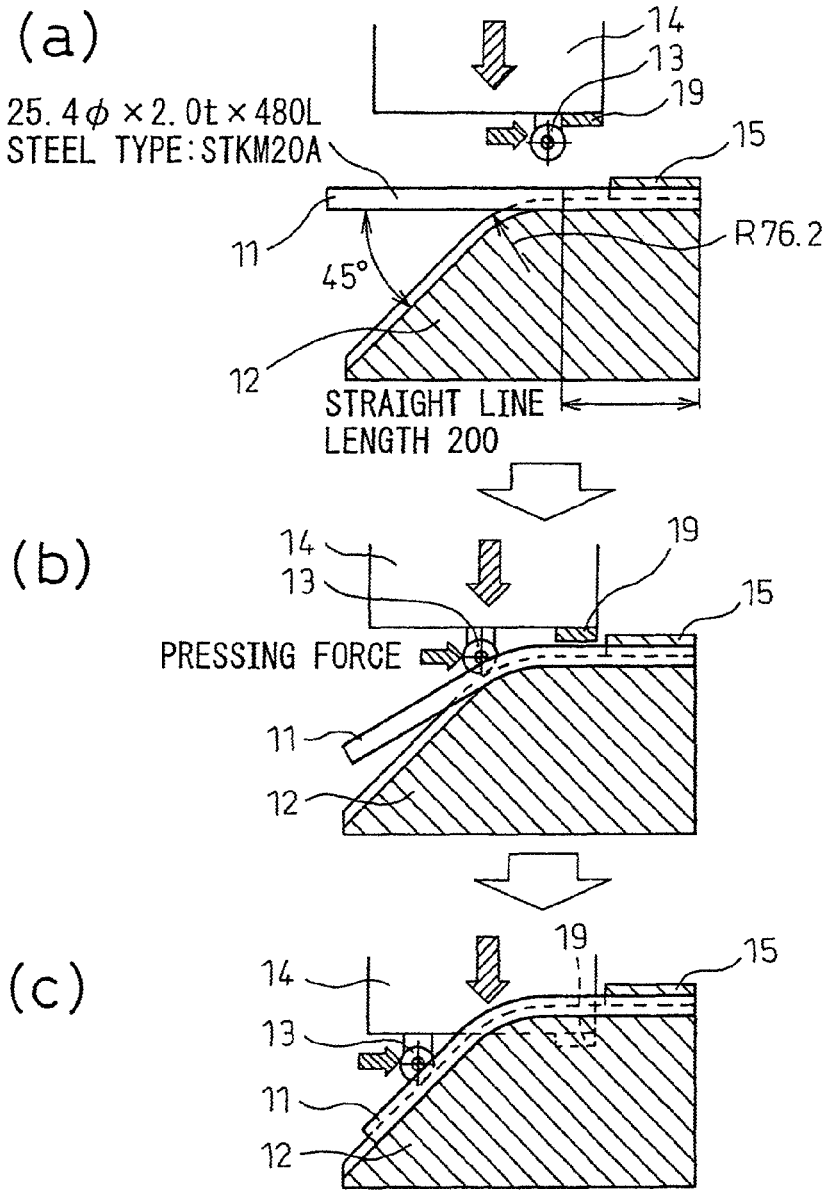
FIG. 27 is a view explaining Example 8 of the present invention, wherein (a) to (c) are cross-sectional views showing the order of the bending method.

FIG. 27 is an example of using a single roll 13 to bend a tube material 11 at one location. The shapes of the grooves 12*a*, 13*a* of the punch 12 and the roll 13 were made simple circular cross-sections, while for the tube material 11, a tube material 11 the same as the thickness 2.0 t material used in Examples 1 to 4 was used. Further, the roll 13 is made to slide with respect to the frame 14 and rotate with respect to the punch 12 by making the top surface of the roll end part 30 contacting the frame 14 a flat surface and making the bottom part of the roll end part 30 contacting the outer circumference of the punch 12 a semicircular shape (not shown). Further, the roll center part 31 was made an hourglass shape having a semicircular groove 13*a* (not shown). The initial position of the roll 13 is made the position as shown in (a) of FIG. 26 by the stopper 19. As a result of the bending, a shaped article with one side forming a straight tube and the other bent was obtained.

INDUSTRIAL APPLICABILITY

The present invention is useful for bending tube materials used for manufacturing auto parts, building material parts, furniture parts, etc. and tube materials used for piping in various facilities.

According to the present invention, it is possible to lower the cost of bending by a large bending radius which was high in apparatus cost and die cost with conventional draw bending and press bending and possible to lower the production costs since high productivity bending becomes possible. On the one hand, bending which was not possible with the conventional ram bending due to the occurrence of wrinkling and buckling at the inner side of bending becomes possible without the occurrence of wrinkling and buckling. Because of this, the range of application of bent parts of tube materials in auto parts, building material parts, furniture parts, and the like is further expanded. This not only can contribute to lighter weights, but also enables reduction of the production costs.

The invention claimed is:

1. A ram bending apparatus for bending tube material, the apparatus comprising:

a punch and a set of rolls for three-point bending a tube material, wherein the punch has a groove, the punch groove having a width equal to at least a width of the tube material outer circumference, the set of rolls is supported by a frame, the set of rolls is between the punch and the frame, the set of rolls is configured to be in contact with the punch and the frame and configured to slide on the frame away from each other while contacting the punch when the tube material is in contact with the rolls and the punch, wherein each said roll has at its center part a groove having a width equal to at least a width of the tube material outer circumference, and the frame has a hollow part sufficiently wide to permit the punch and the tube material to freely move within the hollow part during bending of the tube material, and wherein the punch is in contact with the set of rolls from start to finish of the ram bending.

2. A ram bending method of a tube material, comprising:

inserting a tube material into a groove provided in an outer circumference of a punch, clamping the tube material by a set of rolls and part of the punch, wherein said set of rolls is positioned at an opposite side of the tube material from the punch and supported by a frame, wherein the set of rolls is between the punch and the frame, and moving the punch to the frame side, and sliding the set of rolls on the frame in directions away from each other while contacting the punch when the tube material is in contact with the rolls and the punch, bending the tube material to the shape of the punch, and wherein the punch is in contact with the set of rolls from start to finish of the ram bending.

3. The ram bending apparatus as set forth in claim 1, wherein part or all of the grooves of center parts of the rolls and the punch have a shape selected from the group consisting of semicircular shapes, elliptical shapes, rectangular shapes, polygonal shapes, and shapes formed of combinations of curved lines.

4. The ram bending apparatus as set forth in claim 1, wherein the tube material has a burled part, and the punch further comprises a hollow part configured to fit over the burled part of the tube material.

5. The ram bending apparatus as set forth in claim 1, wherein the rolls are configured to rotate with respect to the frame.

6. The ram bending apparatus as set forth in claim 1, wherein the rolls are configured to rotate with respect to the punch.

7. The ram bending apparatus as set forth in claim 6, further comprising a driving device configured to drive rotation of the rolls to rotate outward from each other.

8. The ram bending apparatus as set forth in claim 6, further comprising a driving device configured to drive rotation of the rolls to rotate inward toward each other.

9. The ram bending apparatus as set forth in claim 1, wherein the rolls are configured to freely move in an axial direction of the rolls.

10. The ram bending apparatus as set forth in claim 1, wherein a surface of the frame on which the rolls move forms an acute angle with a direction of progression of the punch.

11. The ram bending method of a tube material as set forth in claim 2, wherein said punch has a groove having a width equal to at least a width of the tube material outer circumference, wherein said rolls each have a groove at its center part having a width equal to at least a width of the tube material outer circumference, and wherein part or all of grooves of the rolls and the punch have a shape selected from the group consisting of semicircular shapes, elliptical shapes, rectangular shapes, polygonal shapes, and shapes of combinations of curved lines, thereby simultaneously deforming a cross-sectional shape of the tube material deform and bending the material.

12. The ram bending method of a tube material as set forth in claim 2, wherein the tube material is partially burled for bending.

13. The ram bending method of a tube material as set forth in claim 2, further comprising bending the tube material while the rolls rotate with respect to the frame.

14. The ram bending method of a tube material as set forth in claim 2, further comprising bending the tube material while the rolls rotate with respect to the punch.

15. The ram bending method of a tube material as set forth in claim 14, further comprising bending the tube material while driving the rotation of the rolls to rotate outward from each other.

16. The ram bending method of a tube material as set forth in claim 14, further comprising bending the tube material while driving the rotation of the rolls to rotate inward toward each other.

17. The ram bending method of a tube material as set forth in claim 2, further comprising bending the tube material while the rolls move in axial directions of the rolls.

18. The ram bending method of a tube material as set forth in claim 2, further comprising bending the tube material while the rolls move at an acute angle with respect to a direction of progression of the punch.

19. The ram bending apparatus for bending tube material as set forth in claim 1, further comprising a pressing device configured to apply a pressing force in a direction bringing the rolls close to each other.

20. The ram bending method of a tube material as set forth in claim 2, further comprising applying a pressing force to the rolls in a direction bringing the rolls close to each other.

* * * * *